US008873985B2

(12) United States Patent
Fukuzawa et al.

(10) Patent No.: US 8,873,985 B2
(45) Date of Patent: Oct. 28, 2014

(54) IMAGE FORMING APPARATUS CONTROLLING POWER SUPPLIED TO FIXING UNIT

(75) Inventors: Daizo Fukuzawa, Mishima (JP); Munehito Kurata, Suntou-gun (JP); Noriaki Sato, Suntou-gun (JP); Kuniaki Kasuga, Mishima (JP); Mahito Yoshioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 13/310,973

(22) Filed: Dec. 5, 2011

(65) Prior Publication Data

US 2012/0148282 A1 Jun. 14, 2012

(30) Foreign Application Priority Data

Dec. 9, 2010 (JP) ..... 2010-274586

(51) Int. Cl.
*G03G 15/20* (2006.01)

(52) U.S. Cl.
CPC ..... *G03G 15/2078* (2013.01); *G03G 15/2003* (2013.01); *G03G 15/2082* (2013.01); *G03G 2215/2016* (2013.01); *G03G 2215/2032* (2013.01)
USPC ..... 399/69

(58) Field of Classification Search
CPC ..... G03G 15/20
USPC ..... 396/67–70; 399/67–70
See application file for complete search history.

(56) References Cited

U.S. PATENT DOCUMENTS

| | | | | |
|---|---|---|---|---|
| 5,148,226 | A | 9/1992 | Setoriyama et al. | |
| 5,149,941 | A * | 9/1992 | Hirabayashi et al. | 219/216 |
| 5,525,775 | A | 6/1996 | Setoriyama et al. | |
| 5,966,562 | A * | 10/1999 | Maehara | 399/69 |
| 6,301,454 | B1 * | 10/2001 | Nishida et al. | 399/69 |
| 6,849,833 | B2 * | 2/2005 | Harrington et al. | 219/486 |
| 6,853,818 | B2 | 2/2005 | Nishida | |
| 7,003,239 | B2 | 2/2006 | Tanaka | |
| 7,136,601 | B2 | 11/2006 | Akizuki et al. | |
| 7,310,486 | B2 * | 12/2007 | Kawazu et al. | 399/69 |
| 7,321,738 | B2 * | 1/2008 | Kaji et al. | 399/69 |
| 7,693,439 | B2 * | 4/2010 | Seo et al. | 399/69 |
| 7,734,208 | B2 * | 6/2010 | Seo et al. | 399/69 |
| 7,945,181 | B2 * | 5/2011 | Okada | 399/69 |
| 8,036,558 | B2 * | 10/2011 | Nakashima | 399/69 |

(Continued)

FOREIGN PATENT DOCUMENTS

| | | | |
|---|---|---|---|
| JP | 63-313182 | A | 12/1988 |
| JP | 02-157878 | A | 6/1990 |

(Continued)

OTHER PUBLICATIONS

Office Action mailed Aug. 12, 2014, in Japanese Patent Appln. No. 2010-274586, Japanese Patent Office.

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

Adjusting the start timing for conveying a printing material from a printing material conveying unit based on a power supply update period for power supplied to a heater allows proper power correction timing to be attained for compensating for a drop in temperature of the endless belt following the printing material entering a fixing nip portion.

17 Claims, 13 Drawing Sheets

(56) References Cited

U.S. PATENT DOCUMENTS

| | | | | |
|---|---|---|---|---|
| 8,103,183 | B2 * | 1/2012 | Nemoto et al. | 399/69 |
| 8,260,165 | B2 * | 9/2012 | Chosokabe et al. | 399/67 |
| 8,275,278 | B2 * | 9/2012 | Ishigaya et al. | 399/70 |
| 8,301,051 | B2 * | 10/2012 | Ogiso et al. | 399/69 |
| 8,331,819 | B2 * | 12/2012 | Fukuzawa et al. | 399/69 |
| 2013/0004193 | A1 * | 1/2013 | Park et al. | 399/69 |

FOREIGN PATENT DOCUMENTS

| | | | |
|---|---|---|---|
| JP | 04-044075 | A | 2/1992 |
| JP | 04-044076 | A | 2/1992 |
| JP | 06-118838 | A | 4/1994 |
| JP | 09-101718 | A | 4/1997 |
| JP | 09-106215 | A | 4/1997 |
| JP | 10-333490 | A | 12/1998 |
| JP | 11-015303 | A | 1/1999 |
| JP | 2000-268939 | A | 9/2000 |
| JP | 2001-100588 | A | 4/2001 |
| JP | 2003-123941 | A | 4/2003 |
| JP | 2004-078181 | A | 3/2004 |
| JP | 2004-198535 | A | 7/2004 |
| JP | 2009-025831 | A | 2/2009 |

* cited by examiner

IMAGE FORMING APPARATUS CONTROLLING POWER SUPPLIED TO FIXING UNIT

BACKGROUND OF THE INVENTION

1. Field of the Invention

The present invention relates to an image forming apparatus utilizing an electrophotographic process or the like.

2. Description of the Related Art

Heretofore, image forming apparatuses such as copiers and printers that use an image forming process such as an electrophotographic process, an electrostatic recording process or a magnetic recording process, for example, have been provided with a fixing apparatus for using heat to fuse and fix an unfixed toner image on printing material. As for fixing apparatuses for printing material, in terms of method and configuration, apparatuses that employ a heat roller method, a heat plate method, a heat chamber method and a film heating method are known. Fixing apparatuses all incorporate a heating body, and temperature control is managed by controlling power supply to the heating body, such that the temperature of the heating body is maintained at a prescribed temperature (prescribed image fixing temperature, etc.). Among the various types of fixing apparatuses, film-heating type fixing apparatuses particularly enable power savings and wait time reductions (quick start), since they are able to use a thin film or a heating body with a short warm-up period and a low heat capacity. Also in recent years, a fixing apparatus configured to reduce uneven fusing of toner due to the contours of the printing material by providing an elastic layer in the heating film has been proposed.

With a fixing apparatus employing the film heating method, A/D conversion is performed on the detected temperature output of a thermistor provided on the heating body, and a CPU imports the A/D converted output and compares the detected temperature with a target temperature. The CPU controls power supply to the heating body by PID control that is based on a predetermined control table, according to the comparison result. Power supply to the heating body is controlled by performing ON/OFF control of an AC input voltage using a gate-controlled semiconductor switch (hereinafter, triac), with wave number control or phase control being used for power supply control. Wave number control involves performing ON/OFF control in units of half waves such that the AC input voltage is turned ON for a number of waves and turned OFF for a number of waves every prescribed period, with several waves of the AC input voltage being taken as the prescribed period, and is performed by controlling a power supply rate with the ON/OFF duty ratio during the prescribed period. On the other hand, phase control is performed by controlling the phase angle of individual waves of the AC input voltage. Wave number control characteristically results in low harmonic current but high flicker noise, since the power supply rate is controlled every prescribed period of several waves. On the other hand, phase control characteristically results in low flicker noise but high harmonic current, since the power supply rate can be finely controlled within individual half waves. Accordingly, the respective power supply controls are selected according to the requirements of the fixing apparatus, and in the case of using a 200 V commercial power supply, wave number control rather than phase control is often employed particularly in recent years in order to reduce harmonic current. Thus, for example, in Japanese Patent Laid-Open No. 10-333490, a fixing apparatus configured to switch between wave number control and phase control according to the 100 V/200 V AC input voltage has also been proposed. In Japanese Patent Laid-Open No. 2003-123941, a method has also been proposed for combining phase control and wave number control and performing finer control by reducing harmonic current in comparison to when only phase control is used and shortening the update period of the power supply rate in comparison to when only wave number control is used.

Incidentally, when, in the case where wave number control is used with a fixing apparatus employing the film heating method, the power supply is often OFF at the leading edge portion of the printing material because of wave number control resulting in power supply being turned ON/OFF in units of half waves, fixing failure will occur due to the temperature of the heater suddenly dropping. In order to prevent this, Japanese Patent Laid-Open No. 6-118838 proposes a method of increasing power supplied to the leading edge portion of the printing material. Also, with a fixing apparatus employing the film heating method, particularly a fixing apparatus in which the heating film is provided with an elastic layer, the heating state of the printing material will be destabilized due to the printing material entering the heating nip portion. This is caused by the large fluctuation in temperature that occurs in the heating nip portion due to the heating film temperature suddenly dropping because of heat suddenly being absorbed by the printing material when the printing material enters the stable temperature state, and the overshoot that arises when the temperature subsequently increases. In view of this, a method of correcting power supplied to the heating body before the temperature fluctuation due to entry of the printing material occurs is disclosed by the applicant in Japanese Patent Laid-Open No. 2004-078181.

Incidentally, when the temperature of the heating film drops suddenly after the printing material enters the heating nip portion, the temperature of the portion where the heating film has dropped in temperature will still be low when the heating film again contacts the printing material after completing one rotation. As a result, the temperature of the heating film will be low at the portion of the printing material corresponding to the second rotation of the heating film, causing a phenomenon to occur in which the gloss of the image is reduced. On the other hand, the large drop in the temperature of the heating film only occurs immediately after entry of the printing material, and the temperature state is soon stabilized to some extent by PID control, eliminating the temperature drop. Accordingly, even at the portion of the printing material corresponding to the second rotation of the heating film, the reduction in the gloss of the image is only at the portion near the leading edge of the second rotation. However, since the gloss of an image differs greatly between the portion near the leading edge of the second rotation of the heating film and the portion near the trailing edge of the first rotation, the difference in gloss may appear as a clear difference in levels at the boundary therebetween, with this being particularly noticeable when glossy paper is used.

In order to reduce this difference in gloss level, the above-mentioned power correction has to be more finely controlled, such that the gloss is the same where the first and second rotations of the heating film join. That is, even when heat is absorbed and the temperature drops at the leading edge portion of the first rotation, the temperature drop at the leading edge portion of the second rotation of the heating film has to be compensated for, such that the leading edge portion of the second rotation and the trailing edge portion of the first rotation will be the same temperature. Thus, when power correction for forcibly inputting a prescribed amount of power is performed before entry of the printing material, the forcibly input power, or in other words, heat energy, is conveyed to the heating film surface for one rotation, even when the heating film surface experiences a one-off drop in temperature due to entry of the printing material. The temperature then returns to the prescribed temperature when the portion where the temperature dropped is offset and the leading edge portion of the second rotation of the heating film that corresponds to the portion where the printing material initially entered again contacts the printing material. Accordingly, with this control, the timing at which power correction is performed is determined based on the entry timing of the printing material.

As is clear from this mechanism, the inner surface portion of the heating film that is warmed by the heat produced by the power correction has to substantially coincide with the portion where the temperature dropped due to the entry of the printing material, with an even more rigorous accuracy required than in the case where temperature control is merely stabilized. Since the glossiness of printing material such as glossy paper in particular is extremely sensitivity to temperature, and very slight differences in temperature appear as a difference in gloss level, the range within which surface temperature should be controlled is very limited. Further, in order to make the trailing edge portion of the first rotation of the heating film and the leading edge portion of the second rotation the same temperature, power correction for accurately compensating for the temperature drop at the leading edge portion of the second rotation needs to be performed, and thus not only power but also highly accurate timing of when to perform the power correction is required. When the power correction timing deviates even slightly from the proper correction timing, either there will be insufficient power to be able to fully compensate for the temperature drop or a hot offset or the like will occur due to excessive power input, weakening the effect of the power correction. Also, with a fixing apparatus employing wave number control, there is a problem in that temperature fluctuation due to entry of the printing material cannot be adequately reduced because correction cannot be performed at the timing at which power correction should be performed in response to entry of the printing material. This is caused by the fact that since the period for updating the power supply rate of wave number control is in units of half waves, the update period is extended, and, as a result, there are virtually no instances where the update timing coincides with the power correction timing.

FIG. 8 is a timing chart indicating the update period of the power supply rate of wave number control and phase control, and the timing of printing material entry and power correction. In FIG. 8, A indicates the power supply rate update timing of wave number control, with the power supply rate update period of wave number control being 20 half waves. When the power supply frequency of an AC power supply is 50 Hz, the duration of one half wave is 10 msec, and the update period of wave number control is 200 msec. B indicates the power supply rate update timing of phase control, with the update period being two half waves (=20 msec). A power correction start command and a power correction end command are issued such that power correction is started 150 msec before entry of the printing material to the heating nip portion (timing C) and ends 50 msec (timing E) after entry of the printing material to the heating nip portion (timing D). Since wave number control has a long power supply rate update period, the timing at which power correction is actually performed may deviate significantly from the proper power correction timing. For example, since the wave number control shown in FIG. 8 controls the power supply rate in units of 20 half waves (=200 msec), a gap (delay) of 200 msec at most occurs before correction is actually executed after the power correction start command is issued. Since the power correction time period shown in FIG. 8 is 200 msec in total, consisting of 150 msec before and 50 msec after printing material entry, in the case where the power correction start is delayed the most, power correction will be started at the power correction end timing. That is, since the power correction end command will be issued at the same time as the power correction start, power correction will not actually be performed.

In the example described above, since the power supply rate is changed after the correction start command is issued, power correction will be executed later than the power correction start command. Alternatively, although not coinciding with the power supply rate update start timing, if power correction is performed at the power supply rate update timing nearest the power correction start timing, the maximum deviation (delay) in power correction start timing will be slightly alleviated. However, even in this case there will still be a maximum deviation of ±100 msec from the proper power correction timing. FIGS. 9A to 9C are graphs showing the temperature state of the heating film surface in the case where the power correction timing deviates in this manner, with the horizontal axis of each graph showing time and the vertical axis showing surface temperature of the heating film. FIGS. 9A, 9B and 9C respectively show the temperature state of the heating film surface in the case where power correction is performed at the proper timing, power correction is started before the proper timing, and power correction is started after the proper timing. While there is a drop in the temperature of the heating film due to the printing material entering the heating nip portion, in FIG. 9A the difference in the surface temperature of the heating film before and after entry of the printing material to the heating nip portion is kept to about 2° C. In contrast, in FIG. 9B, since there is a significant rise in surface temperature before the printing material enters the heating nip portion, the difference in the surface temperature of the heating film before and after entry of the printing material to the heating nip portion will be 8° C. In FIG. 9C, since there is a significant drop in surface temperature due to the printing material entering the heating nip portion, the difference in the surface temperature of the heating film before and after entry of the printing material to the heating nip portion will similarly be about 8° C.

As shown in FIG. 9B, when power correction is performed before the proper timing, the temperature of the heating nip portion will rise too much and overheat. When the printing material carrying the toner image enters the overheated heating nip portion, the toner becomes excessively fused and hot offset occurs. Also, since a large amount of power is supplied earlier than the proper timing, the temperature of the heating film becomes too high before entry of the printing material, and the gloss of the printing material increases at the trailing edge portion of the first rotation of the film. As a result, horizontal band-like gloss unevenness occurs in which the difference in gloss level between the trailing edge of the first rotation and the leading edge of the second rotation of the heating film is further accentuated. On the other hand, when power correction is performed after the proper timing as shown in FIG. 9C, it will be impossible to compensate for the reduction in heat caused by entry of the printing material, and the temperature of the heating film will drop significantly. In this case, the gloss of the leading edge portion of the second rotation of the heating film will be too low, resulting in gloss unevenness in which the difference in gloss level between the trailing edge portion of the first rotation and the leading edge portion of the second rotation is clearly apparent. To cope with this problem, the update period of the power supply rate can conceivably be shortened, for example, but since the wave number of the update period decreases in this case, the power supply rate cannot be finely set, giving rise to problems with temperature control. Incidentally, even in the case of phase control, deviation in the power correction timing occurs, similarly to wave number control. In the example of FIG. 8, although the amount by which the timing deviates is one full wave (=20 msec) at most, the effect of even with this degree of deviation cannot be considered insignificant. Also, in terms of preventing fixing failure at the leading edge of the printing material, an effect is obtained if the AC input voltage is reliably turned ON at the timing at which the leading edge of the printing material enters the heating nip portion, although in the case where power correction is performed on the printing material, it is important to perform power correction at the prescribed timing and for the prescribed time period. That is, it is important for supply of the prescribed amount of power to be averaged throughout the power correction time period, and thus the power correction time period is set so as basically be an integer multiple of the power supply rate update period.

SUMMARY OF THE INVENTION

The present invention has been made under circumstances such as described above, and is to control temperature fluctuation of a heating nip portion following entry of a printing material, and to reduce gloss unevenness of an image on the printing material.

Another object of the present invention is to provide an image forming apparatus including an image forming unit that forms an unfixed toner image on a printing material, a printing material conveying unit that conveys the printing material to the image forming unit, a fixing unit that fixes the unfixed toner image on the printing material to the printing material by heat, a temperature detecting unit that detects a temperature of the fixing unit, and a control unit that controls the apparatus, the control unit updating, every power supply update period, power supplied to the fixing unit from an AC power supply to power corresponding to the temperature detected by the temperature detecting unit, where the power supply update period corresponds to a prescribed number of continuous half waves of the AC power supply, with the control unit adjusting a timing at which to start conveying printing material from the printing material conveying unit, based on the power supply update period.

Further features of the present invention will become apparent from the following description of exemplary embodiments with reference to the attached drawings.

DESCRIPTION OF THE EMBODIMENTS

Hereinafter, configurations for implementing the present invention will be described in detail using embodiments.

Embodiment 1

Overview of Image Forming Apparatus

Figure 1:
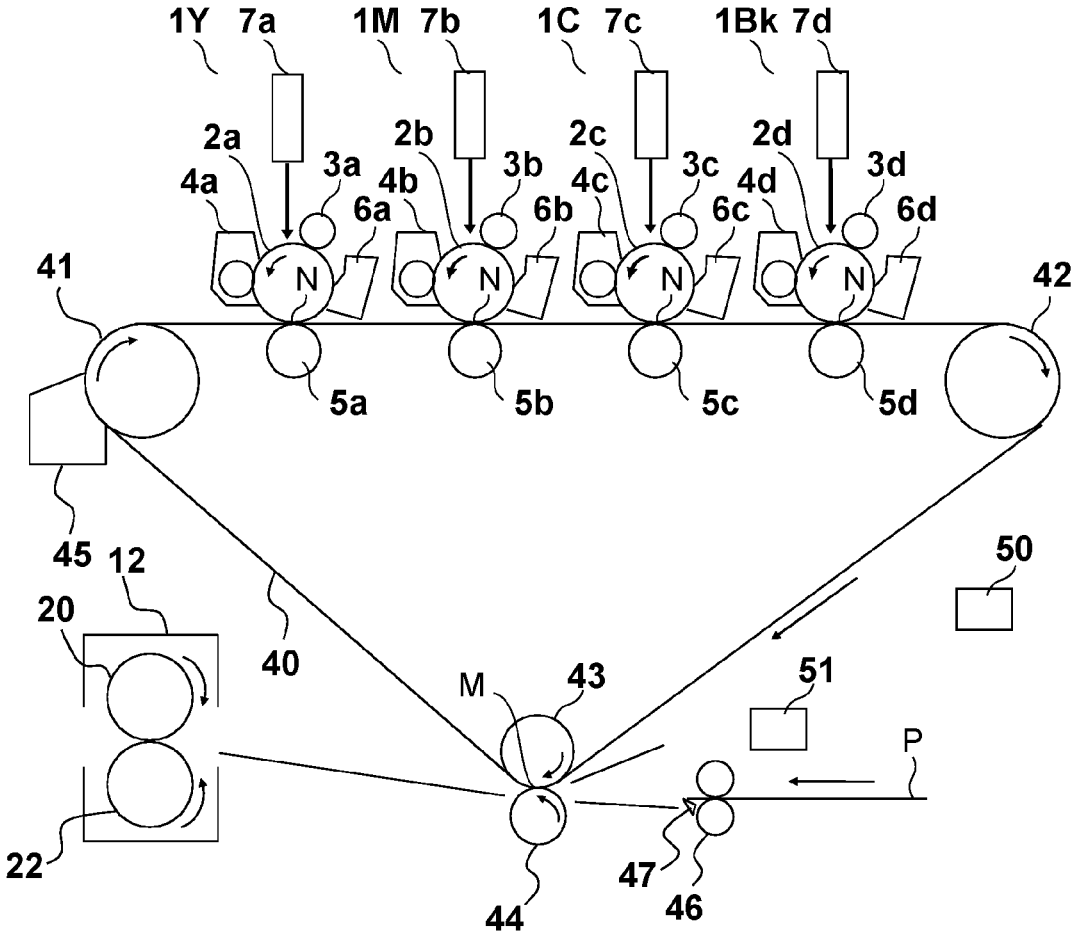
FIG. 1 is a cross-sectional view showing the configuration of a color image forming apparatus of Embodiment 1.

FIG. 1 is a cross-sectional view showing the configuration of a color image forming apparatus of the present embodiment. This color image forming apparatus is a tandem full-color printer employing an electrophotographic method. The color image forming apparatus is provided with four image forming units, namely, an image forming unit 1Y that forms a yellow image, an image forming unit 1M for magenta, an image forming unit 1C for cyan, and an image forming unit 1Bk for black, which are disposed in a row at fixed intervals. Photosensitive drums 2*a*, 2*b*, 2*c*, and 2*d* are respectively installed in the image forming units 1Y, 1M, and 1C and 1Bk (hereinafter, simply referred to as image forming units 1). The letters a, b, c and d respectively correspond to Y (yellow), M (magenta), C (cyan) and Bk (black), and hereinafter will be abbreviated as a~d (or a, b, c and d) unless otherwise required. A charging roller 3, a developing apparatus 4, a transfer roller 5, and a drum cleaning apparatus 6 are installed around each photosensitive drum 2. Also, an exposure apparatus 7 is installed above the area between the charging roller 3 and the developing apparatus 4. Yellow toner, magenta toner, cyan toner, and black toner are respectively stored by the developing apparatuses 4*a*, 4*b*, 4*c*, and 4*d*. An endless-type intermediate transfer belt 40 serving as a transfer medium comes into contact with a primary transfer portion N of each of the photosensitive drums of 2*a*, 2*b*, 2*c*, and 2*d* of the image forming units 1Y, 1M, and 1C and 1Bk. The intermediate transfer belt 40 is tensioned between a driving roller 41, a support roller 42 and a secondary transfer opposing roller 43, and is rotated (moved) in the direction of an arrow (clockwise direction) by the drive of the driving roller 41. Note that the arrows in FIG. 1 indicate rotation direction or conveyance direction. The transfer rollers 5 for use in primary transfer respectively come into contact with the photosensitive drums 2 via the intermediate transfer belt 40 at primary transfer nip portions N. The secondary transfer opposing roller 43 comes into contact with a secondary transfer roller 44 via the intermediate transfer belt 40, and forms a secondary transfer portion M. The secondary transfer roller 44 is installed so as to be able to freely come into contact with and separate from the intermediate transfer belt 40. A belt cleaning apparatus 45 that removes/collects untransferred toner remaining on the surface of the intermediate transfer belt 40 is installed on the outside of the intermediate transfer belt 40 in proximity to the driving roller 41. The fixing apparatus 12 is installed downstream of the secondary transfer portion M in the conveyance direction of a printing material P. An environment sensor 50 and a media sensor 51 are installed in the image forming apparatus.

Next, a sequence operation in which image forming is performed is described. First, when a print signal from an unshown host computer or the like is received, the image forming apparatus starts an image forming preparatory operation (pre-rotation). That is, in the present embodiment, the photosensitive drums 2 of the image forming units 1Y, 1M, and 1C and 1Bk that are rotationally driven at a prescribed process speed are respectively uniformly charged to a negative polarity by the charging rollers 3. Once the image forming preparatory operation ends, an image forming operation start signal (image top signal) is issued next. Then, the exposure apparatuses 7 respectively convert a color-separated input image signal to a light signal with laser output units (not shown), and form an electrostatic latent image on the charged photosensitive drums by exposing and scanning the charged photosensitive drums 2 with laser light, being the resultant light signal. Next, the electrostatic latent image formed on the photosensitive drum 2*a* is visualized to form a toner image on the photosensitive drum 2*a*, by electrostatically adsorbing the yellow toner using the developing apparatus 4*a* to which a developing bias having the same polarity as the charge polarity (negative polarity) of the photosensitive drum 2*a* is applied. Primary transfer to the rotating intermediate transfer belt 40 is performed on this yellow toner image in the primary transfer portion N, using the transfer roller 5*a* to which a primary transfer bias (opposite polarity (positive polarity) to toner) is applied. The intermediate transfer belt 40 to which the yellow toner image has been transferred moves toward the image forming unit 1M.

Next, in the magenta image forming unit 1M, similarly to yellow, the magenta toner image formed on the photosensitive drum 2*b* is transferred at the primary transfer portion N by being overlaid on the yellow toner image on the intermediate transfer belt 40. Similarly, the cyan and black toner images formed on the photosensitive drums of the image forming units 1C and 1Bk are transferred at the respective primary transfer portions N by being superimposed on the superimposed yellow and magenta toner images transferred on the intermediate transfer belt 40, thereby forming a full color toner image on the intermediate transfer belt 40.

Meanwhile, when the leading edge position of the printing material (transfer material) P is detected by a registration sensor 47 after the printing material has been fed/conveyed by an unshown paper feeding mechanism, conveyance of the printing material stopped in this state. The printing material P is then conveyed to the secondary transfer portion M by a registration roller 46, such that the leading edge of the printing material gets to the image forming starting position at the timing at which the leading edge of the toner images on the intermediate transfer belt 40 moves to the secondary transfer portion M. Secondary transfer of the toner images on the intermediate transfer belt 40 to the printing material P is then performed collectively by the secondary transfer roller 44 to which a secondary transfer bias (opposite polarity (positive polarity) to toner) is applied. The printing material P to which the toner images have been transferred is conveyed to the fixing apparatus 12, and after the toner images have been fused and fixed to the surface of the printing material P by having heat and pressure applied thereto at the heating nip portion between a heating film 20 and a pressure roller 22, the printing material P is discharged to the outside of the image forming apparatus, thus ending the series of image forming operations. Note that at the time of primary transfer, toner from the primary transfer that remains on the photosensitive drums 2 is removed/recovered by the drum cleaning apparatuses 6. Also, toner from the secondary transfer that remains on the intermediate transfer belt 40 after the secondary transfer is removed/recovered by the belt cleaning apparatus 45.

Incidentally, the environment sensor 50 is provided in the image forming apparatus, and is used to detect temperature and humidity, in order to adjust the density of the toner images on the printing material P according to environmental condition (temperature, humidity) in the image forming apparatus, and set optimal transfer and fixing conditions. Further, the media sensor 51 is provided in the image forming apparatus, and is used to discriminate the printing material P, in order to set optimal transfer and fixing conditions according to the printing material P.

Outline of Fixing Apparatus (1) Configuration of Fixing Apparatus

Figure 2A:
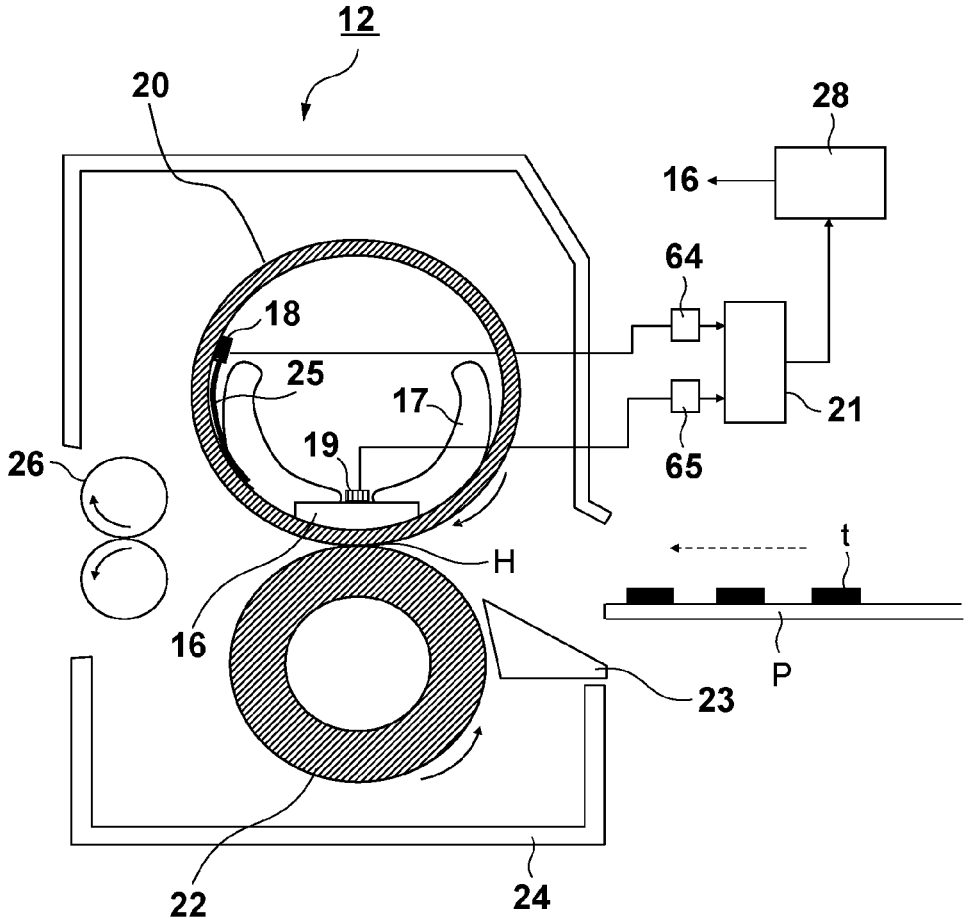
FIG. 2A is a cross-sectional view showing the configuration of a fixing apparatus of embodiments 1 and 2.

FIG. 2A is a cross-sectional view showing the configuration of the fixing apparatus 12 in the present embodiment. The fixing apparatus 12 is a fixing apparatus employing a pressure rotating body drive method (tensionless type) that drivingly rotates a film in relation to a rotating body for applying pressure, by fitting the film loosely into a film guide and driving the pressure rotating body. The heating film (first rotating body) is a cylindrical (endless belt) member obtained by providing a film with an elastic layer. A heater holder 17 holds a heater 16 and acts to loosely fit the heater 16 onto the heating film 20 and guide the heating film 20. The heater 16 is a heating body (heat source) and is arranged on the underside of the heater holder 17 in the longitudinal direction of the holder.

The pressure roller 22 (second rotating body) is obtained by forming a silicone rubber layer on a cored bar and covering this with a PFA resin tube, and is arranged such that both ends of the cored bar are rotatably held with bearings between unshown side plates on the far side and near side of an apparatus frame 24. Above the pressure roller 22, a heating film unit consisting of the heater 16, the heater holder 17, the heating film 20 and the like is disposed in parallel with the pressure roller 22, with the heater 16 side facing down. Both ends of the heater holder 17 are biased toward the pressure roller 22 by an unshown pressure mechanism. The downward face of the heater 16 is thereby pressed against the elastic layer of the pressure roller 22 via the heating film 20 with a prescribed pressing force to form a heating nip portion H having a prescribed width needed for fixing by heat. A pressure mechanism has a pressure-release mechanism, and is configured to release pressure such that removal of the printing material P is facilitated at the time of jam processing or the like.

A main thermistor 18 serving as a temperature detecting unit is contactlessly disposed on the heater 16, and detects the temperature of the inner surface of the heating film 20. In the present embodiment, the main thermistor 18 is attached to the tip of an arm 25 that is fixedly supported by the heater holder 17, and the main thermistor 18 is held so as to always be in contact with the inner surface of the heating film 20, even when the movement of the inner surface of the heating film 20 is destabilized due to the arm 25 swinging elastically. A sub thermistor 19 serving as another temperature detecting unit is disposed nearer the heater 16 than is the main thermistor 18, and, in the present embodiment, contacts the back surface of the heater 16 and detects the temperature of the back surface of the heater 16. The main thermistor 18 and the sub thermistor 19 are respectively connected to a control unit (CPU) 21 (hereinafter, CPU 21) via A/D converters 64 and 65. The CPU 21 determines the settings for controlling the temperature of the heater 16, on the basis of the detected temperature output of the main thermistor 18 and the sub thermistor 19, and controls power supply to the heater 16 via a heater driving circuit 28 serving as a power supply unit. That is, the CPU 21 functions as a power control unit. Note that although the main thermistor 18 detects the inner surface temperature of the heating film 20 in the present embodiment, the main thermistor 18 can also be disposed on the back surface of the heater 16 similarly to the sub thermistor 19 and detect the temperature of the heater 16 directly.

An entrance guide 23 acts to guide the printing material such that the printing material P that has left the secondary transfer nip portion is correctly introduced into the heating nip portion H where the heating film 20 and the pressure roller 22 are pressed together. A discharge roller 26 discharges the printing material P that has passed through the heating nip portion H to the outside of the image forming apparatus.

(2) Pressure Roller

The pressure roller 22 is rotationally driven at a prescribed peripheral velocity in the direction of the arrow in FIG. 2A by a driving unit (not shown). Torque acts on the heating film 20 due to the pressing frictional force in the heating nip portion H between the outer surface of this pressure roller 22 and the heating film 20 generated by the rotational drive of the roller. The heating film 20 is drivingly rotated around the outside of the heater holder 17 in the direction of the arrow in FIG. 2A, while sliding in close contact with the downward surface of the heater 16. When the pressure roller 22 is rotationally driven, the heating film 20 consequently enters a driven rotation state, and temperature control is performed in which power is supplied to the heater 16 and the temperature is raised, warming up to a prescribed temperature. In this state, the printing material P carrying the unfixed toner images is introduced to the heating nip portion H between the heating film 20 and the pressure roller 22 along the entrance guide 23. The toner image carrying surface side of the printing material P is conveyed in close contact with the outer surface of the heating film 20 while being nipped by the heating nip portion H. In the nipping/conveying process, the heat of the heater 16 is imparted to the printing material P via the heating film 20, and unfixed toner images t on the printing material P are fused and fixed to the printing material P by applying heat and pressure thereto. The printing material P that has passed through the heating nip portion H is self-stripped from the heating film 20, and discharged by the discharge roller 26.

(3) Heating Film

The heating film 20 is a cylindrical (endless belt) member obtained by providing a film with an elastic layer. In the present embodiment, the heating film 20 is designed so as to warm up to 190° C. within 20 seconds after approximately 1000 W of power is supplied to the heater 16 when warming up from a room temperature state.

(4) Thermistors

Figure 2B:
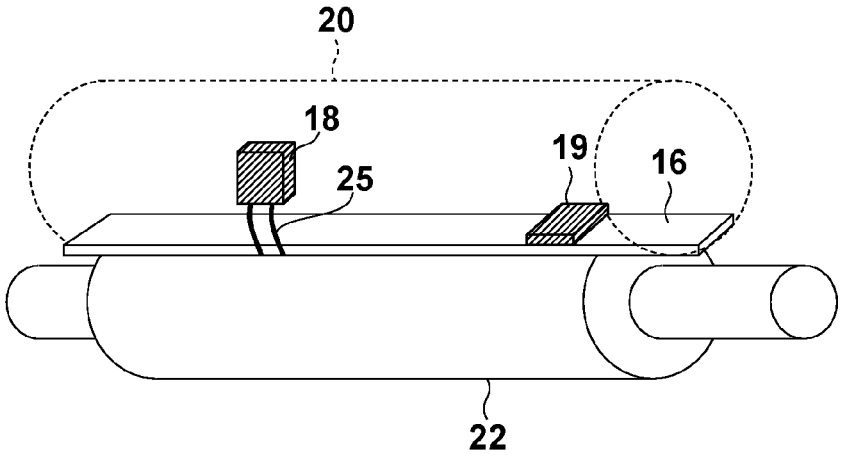
FIG. 2B is a perspective view showing the positional relationship between a heater, a main thermistor and a sub thermistor.

FIG. 2B is a perspective view showing the positional relationship of the heater 16, the main thermistor 18, and the sub thermistor 19 in the fixing apparatus of the present embodiment. The main thermistor 18 and the sub thermistor 19 are respectively arranged near the longitudinal center of the heating film 20 and near an end portion of the heater 16, and are disposed so as to respectively come into contact with the inner surface of the heating film 20 and the back surface of the heater 16. The main thermistor 18 is used as a means of detecting the temperature of the heating film 20, which is the temperature nearest the temperature of the heating nip portion H. Accordingly, at the time of normal operation, temperature control (i.e., control of power to the heater 16) is performed such that the detected temperature of the main thermistor 18 will be a target temperature. Note that as mentioned above, the main thermistor 18 may be disposed on the back surface of the heater 16, in which case, temperature control will be performed with the temperature of the back surface of the heater as the target temperature.

The sub thermistor 19 acts as a monitoring apparatus that detects the temperature of the heater 16 serving as a heating body, and monitors the temperature of the heater so as to not exceed a prescribed temperature. Also, overshooting the temperature of the heater 16 at the time of warming up and rises in temperature at the end portion of the heater 16 are monitored by the sub thermistor 19. In the case where, for example, the temperature at the end portion of the heater 16 exceeds a prescribed temperature due to the temperature of the end portion rising, control is performed to reduce throughput (number of image forming sheets per unit time) or the like, so that the temperature of the end portion does rise any further.

(5) Heater

Figure 3A:
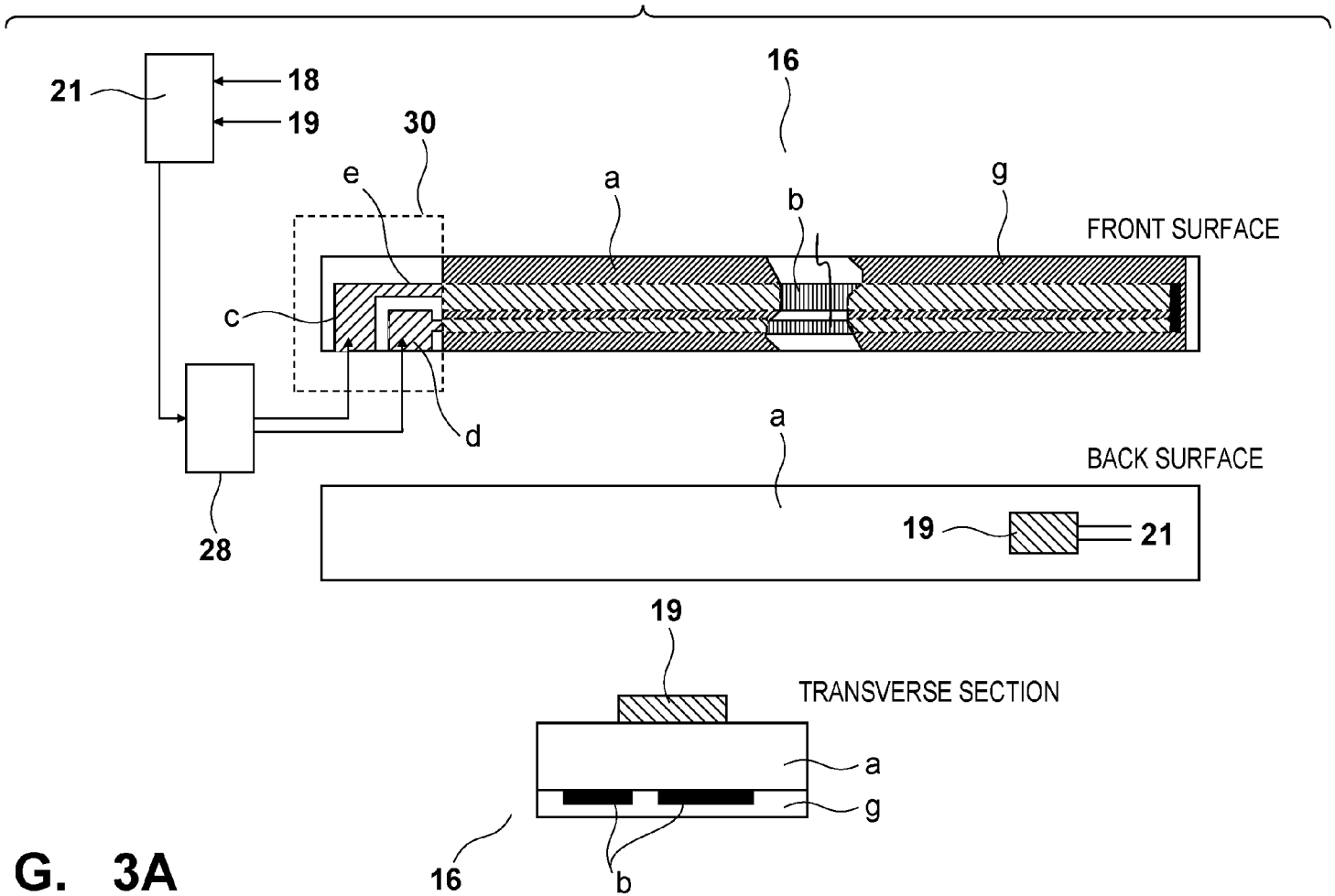
FIG. 3A is a structural diagram of a ceramic heater.

The heater 16 is a ceramic heater obtained by coating a resistance heating element with pressure-resistant glass. FIG. 3A is a diagram showing an example structure (front surface, back surface, cross-section) of such a ceramic heater. In FIG. 3A, the heater 16 has a resistance heating element layer b on the front surface side of a substrate a whose longitudinal direction is orthogonal to the conveying direction. Further, the heater 16 has first and second electrode portions c and d and an extended circuit portion e as power supply patterns to the resistance heating element layer b. Also, the heater 16 is provided with a glass coat g formed on the resistance heating element layer b and the extended circuit portion e for protection and insulation, the sub thermistor 19 provided on the back surface side of the substrate a, and the like. The heater 16 is fixedly supported by the heater holder 17 with the front surface side downwardly exposed. A power supply connector 30 is mounted on the electrode portion c and d side of the heater 16, and when power is supplied from the heater driving circuit 28 to the electrode portions c and d via the power supply connector 30, the resistance heating element layer b generates heat and the temperature of the heater 16 quickly rises. The heater driving circuit 28 is controlled by the CPU 21. During normal use, the heating film 20 is drivingly rotated when rotation of the pressure roller 22 is started, and the inner surface temperature of the heating film 20 also increases with the increase in the temperature of the heater 16. Power supply to the heater 16 is controlled by PID control, and power supplied to the heater 16 is controlled by the CPU 21 such that the inner surface temperature of the heating film 20, that is, the temperature detected by the main thermistor 18, will be 190° C.

Outline of Heater Drive Circuit

Figure 3B:
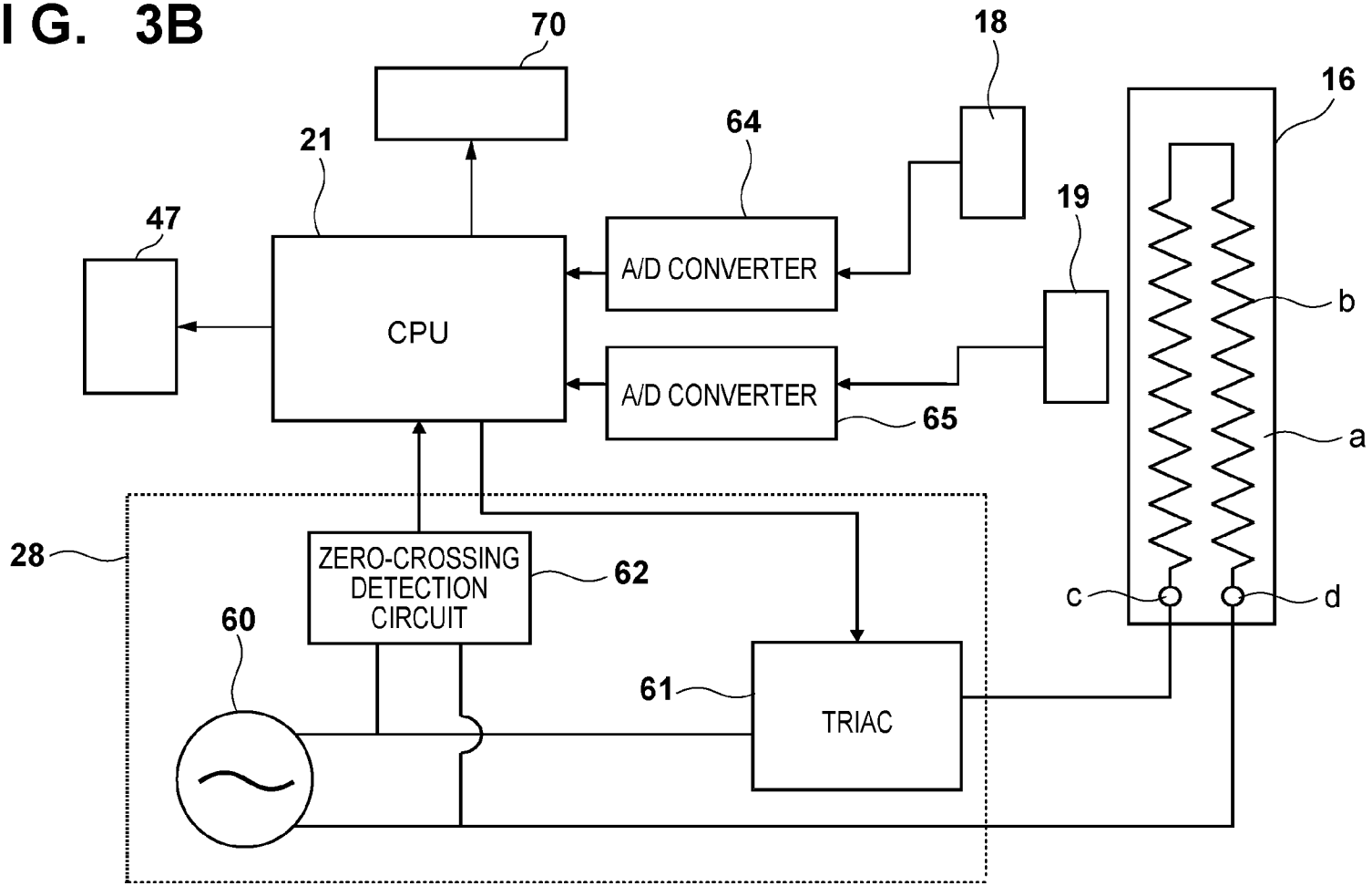
FIG. 3B is a block diagram of a heater driving circuit and a control unit of the fixing apparatus.

FIG. 3B is a block diagram of the heater driving circuit 28 and the CPU 21 serving as a temperature control unit of fixing apparatus. The power supply electrode portions c and d of the heater 16 are connected to the heater driving circuit 28 via the power supply connector (not shown). In the heater driving circuit 28, a triac 61 is controlled by the CPU 21 and supplies and interrupts power to the resistance heating element layer b of the heater 16. A zero crossing detection circuit 62 monitors the output voltage of an AC power supply 60 and sends a zero crossing signal to the CPU 21 when a zero voltage is detected, and the CPU 21 controls the triac 61 on the basis of this zero crossing signal. The temperature of the entire heater 16 rapidly rises as a result of the heater driving circuit 28 supplying power to the resistance heating element layer b of the heater 16.

Detected temperature information is output from the main thermistor 18 which detects the temperature of the heating film 20 and the sub thermistor 19 which detects the temperature of the heater 16, and respectively input to the CPU 21 via the A/D converters 64 and 65. The CPU 21 performs PID control on the power supplied to the heater 16 by the triac 61, based on the detected temperature information on the heating film 20 input from the main thermistor 18, and maintains the temperature of the heating film 20 at a prescribed control target temperature (set temperature). PID control is control for deciding control values, by combining proportional control (P control), integral control (I control) and derivative control (D control) according to output values from a control target.

Also, in the present embodiment, wave number control that takes a prescribed number of continuous half waves as the update period is used as the method of controlling the power supplied. Wave number control in the present embodiment updates the power supply rate in units of 20 half waves. That is, in the case where the power supply rate is controlled in 5% increments from 0 half wave ON (0% power supply) to 20 half wave ON (100% power supply), and the power supply frequency of the AC power supply is 50 Hz, the update period of the power supply rate will be 200 msec, with the power supply rate being updated every update period (200 msec). Since a zero crossing signal is sent from the zero crossing detection circuit 62 to the CPU 21 as mentioned above, the CPU 21 can accurately perform ON/OFF control of the triac 61 based on the AC voltage waveform. The CPU 21 controls operation of not only the fixing apparatus 12 but also the entire image forming apparatus, via an image forming unit drive circuit 70, and motor drive in the image forming units, bias application, laser exposure, and conveyance control of the printing material are also performed at the same time. The CPU 21 further detects the leading edge position of the printing material P, using input from the registration sensor 47. The CPU 21 has a ROM, a RAM and a timer for use in time measurement and the like, all of which are not shown. A program and various data for controlling the image forming operation of the image forming apparatus are stored in the ROM, and the RAM is used for operations, temporary memory and the like of data required for controlling the image forming operation of the image forming apparatus.

Setting of Power Correction Timing (1) Power Correction Time Period

In the present embodiment, the CPU 21 stops PID control 200 msec before the printing material P enters the heating nip portion H, and performs power correction for additionally supply a prescribed amount of power from that point until the printing material enters the heating nip portion H. The time period during which PID control is stopped and the prescribed amount of power is supplied and the amount of power correction are set such that heating unevenness (difference in gloss level) that occurs between the trailing edge of the first rotation of the heating film 20 and the leading edge of the second rotation at the time of heating the printing material with the heating film will be minimized. At the time of actual image forming, power supply control is performed by adding the correction amount to the power supply rate selected by PID control at the time of the normal temperature control before the start of power correction. For example, in the case where power correction of +10% is performed in a state where a power supply rate of 20% has been selected with PID control, the power supply rate at the time of power correction will be 30% (i.e., 20%+10%). With this method, since the power supply rate selected at the time of PID control differs depending on the temperature of the heating film and the like, the power supply rate at the time of correction will also differ with the temperature state of the heating film. However, since the amount of heat retained by the heating film until the point at which power correction is started differs depending on the accumulation of heat and the like, control reflecting the state of the heating film is more useful in terms of eliminating heating unevenness. Note that it is practically feasible to provide the power supplied at the time of correction in advance as a fixed value (e.g., 100 W, etc.) rather than with the power supply rate.

Incidentally, power correction is started before the printing material P enters the heating nip portion H in consideration of the time taken for the temperature of the heater 16 to increase after correction power is actually supplied. That is, the heater temperature cannot immediately follow the sudden supply of power to the heater 16, and there is a slight time lag before the actual power supply is reflected in the heater temperature. Further, since thermal contact resistance exists on the inner surface of the heating film 20, heat from the heater 16 is not immediately conveyed to the heating film 20. Accordingly, it is too late to properly supply the heat of the heating film 20 to the leading edge portion of the printing material P after the leading edge of the printing material P has entered the heating nip portion H. In view of this, the time lag before the rise in heat of the heating film 20 is calculated into the timing at which to start power correction, and in the present embodiment power correction is started 200 msec before the printing material P enters the heating nip portion H.

In the present embodiment, this power correction start timing is set so that there is a slight margin with respect to the entry timing of the printing material P to the heating nip portion H. Although the timing at which heat generation by the heater 16 is reflected in the temperature of the inner surface of the heating film 20 preferably coincides with the entry timing of the printing material P, the actual power correction is started slightly earlier than this timing. This is because of a decision having been made, in consideration of the variation in heat transfer, to adjust the settings such that power correction is started slightly early and the temperature of the heating film 20 is a little high, rather than performing the power correction later and with the temperature of the heating film lower. Although the margin allowed in the present embodiment is practically feasible, the risk of hot offset occurring increases the greater this margin. Note that this setting is not limited to the configuration of the present embodiment, and can be suitably varied.

(2) Power Correction Start Timing

If the power correction start timing and the power supply rate update timing do not coincide in the case of performing power correction, the actual power correction start timing will deviate. As a result, not only is it impossible to eliminate the difference in gloss level that occurs at the position corresponding to where the first and second rotations of the heating film join in the image on the printing material P but hot offset or the like is conversely generated, as mentioned above. Thus, the power correction time period is set so as to basically be an integral multiple of the power supply rate update period, and, in the present embodiment, controls the conveyance start timing of the printing material P such that the power correction start timing coincides with the update timing of the power supply rate.

In the present embodiment, the power correction start timing is determined based on the timing at which the printing material P enters the heating nip portion H, in and, in the present embodiment, is 200 msec before entry to the heating nip portion H. As mentioned above, power correction needs to be executed before the printing material P enters the heating nip portion H, and thus the timing at which the printing material P enters the heating nip portion H needs to be accurately predicted. The entry timing of the printing material P to the heating nip portion H is, in the present embodiment, predicted using the conveyance start timing of the printing material P by the registration roller 46 as a basis. That is, since the leading edge of the printing material P is positioned at the registration sensor 47 when conveyance is started by the registration roller 46, the printing material P is conveyed at a fixed speed from that position, enabling the time required until it enters the heating nip portion H to be predicted. Accordingly, the power correction start timing is set using the conveyance start of the printing material P obtained by counting backwards from the entry timing of the printing material P to the heating nip portion H as a basis. Note that although this operation is referred to here as "prediction", the time required for entry to the heating nip portion H from the conveyance start of the printing material P is in fact a fixed value that can calculated in advance using the conveyance distance and conveyance speed of the printing material P in the image forming apparatus. Accordingly, if the entry timing of the printing material P to the heating nip portion H is controlled by adjusting the conveyance start timing of the printing material P, it is possible to reliably align the power correction start timing and the power supply rate update timing.

The conveyance start timing of the printing material is determined such that the leading edge of the toner images on the intermediate transfer belt 40 coincides with the image forming start position of the printing material. Accordingly, in the case of the present embodiment, the image forming start timing for starting scanning exposure of the photosensitive drum 2 with laser light using the exposure apparatus 7 will be adjusted, going back further from the transfer of the toner images to the intermediate transfer belt 40. That is, the timing for emitting the image forming operation start signal will be controlled based on the update timing of the power supply rate.

(3) Timing Chart for Power Correction Control

Figure 4A:
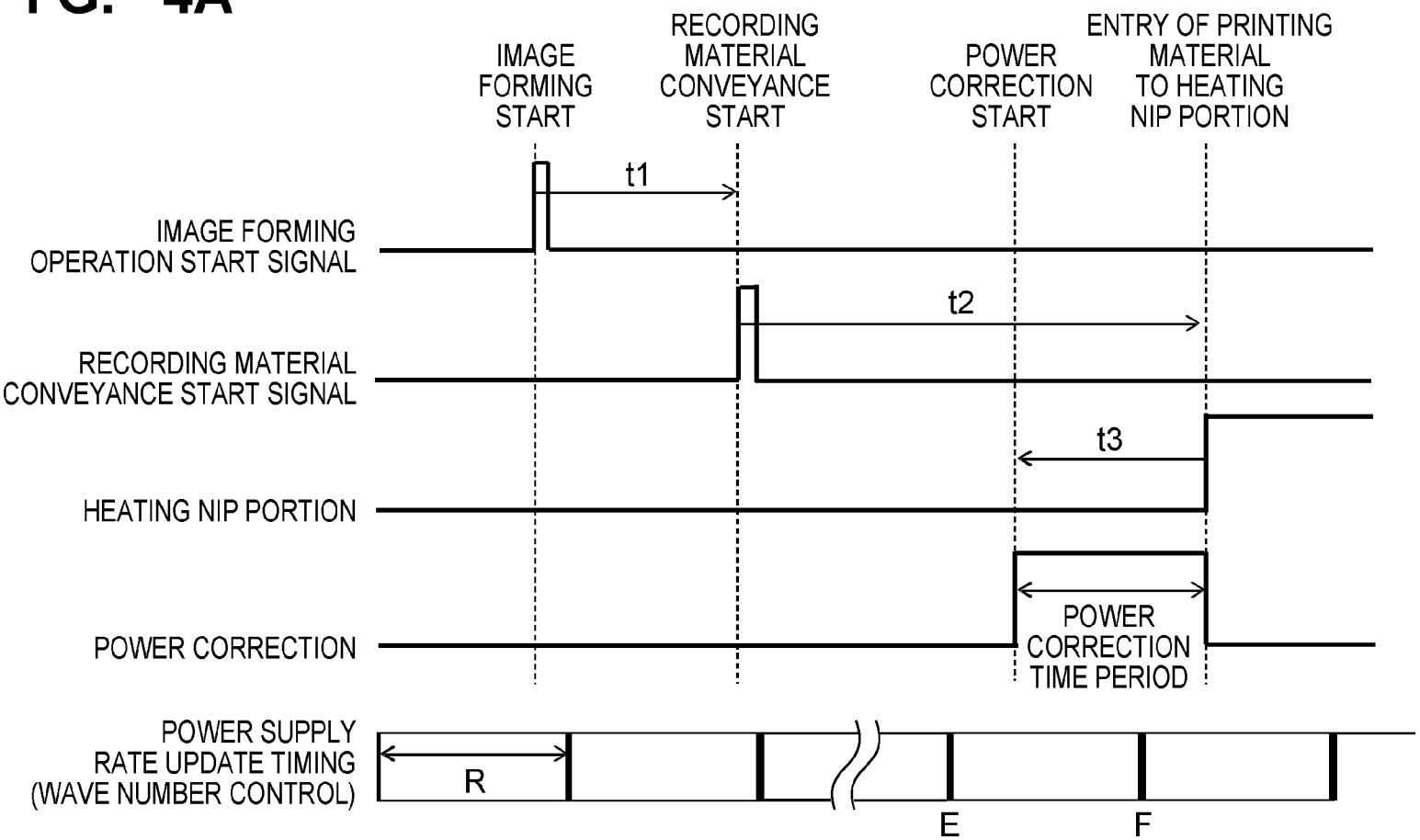
FIGS. 4A and 4B are timing charts showing image forming start, power correction and power supply rate update timing in Embodiment 1.
Figure 4B:
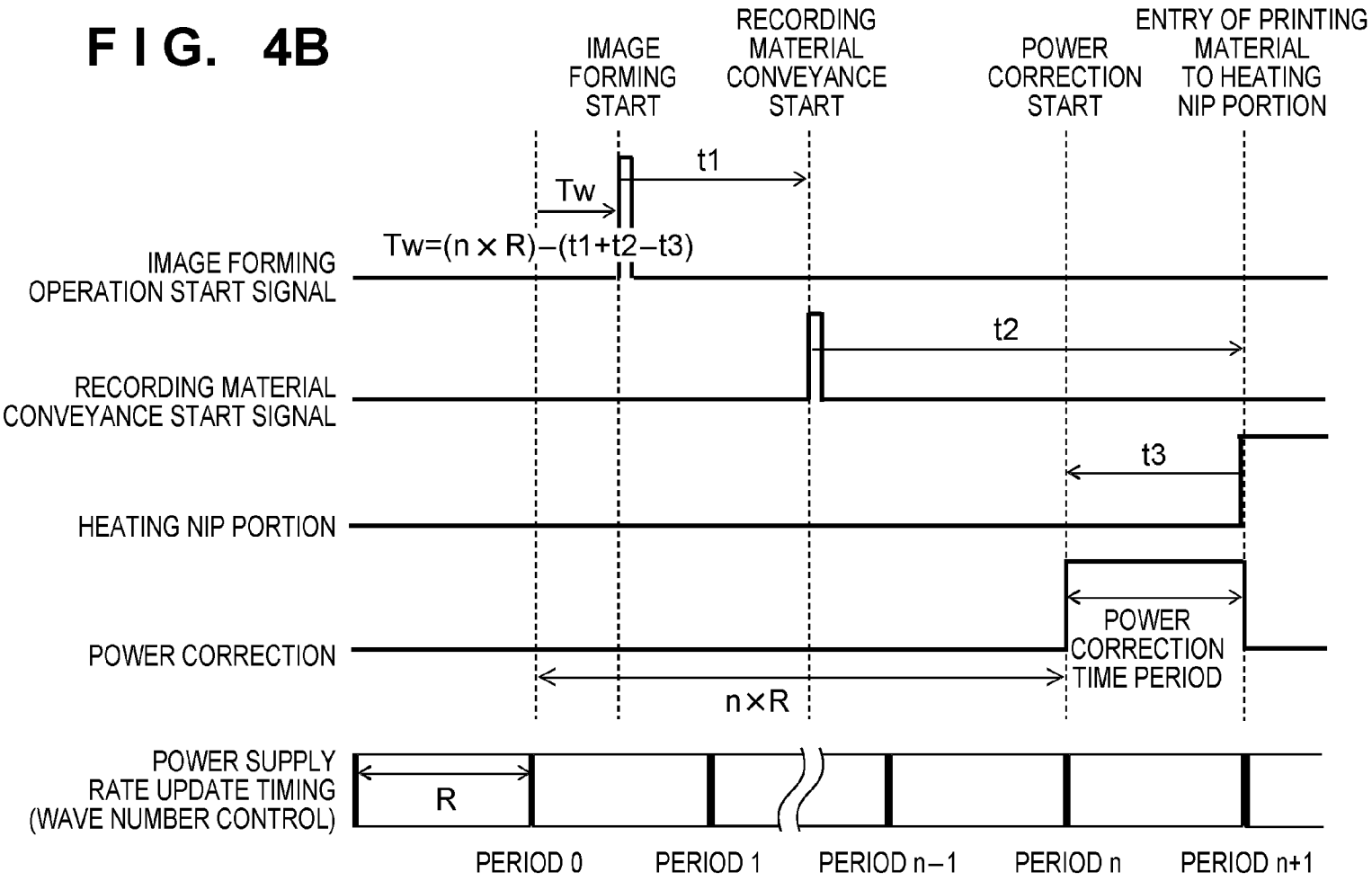

Next, the power correction control procedure is described using FIG. 4A and FIG. 4B. FIG. 4A is a timing chart of a conventional case where the start of the image forming operation is not based on the update timing of the power supply rate. In FIG. 4A, the image forming operation is started once an image forming preparatory operation (pre-rotation) is completed and the image forming operation start signal is output, and after time t1 (third prescribed time) has elapsed therefrom, a printing material conveyance start signal is output and conveyance of the printing material P is started. Time t1 is the adjustment time for aligning the image forming starting position on the printing material and the leading edge of the toner images on an intermediate transfer belt at the secondary transfer portion M. The printing material P enters the heating nip portion H after time t2 (second prescribed time) has further elapsed. Counting backwards from this timing, power correction is started time t3 earlier (in the present embodiment, 200 msec earlier). Incidentally, since times t1, t2 and t3 are all fixed values, the power correction start timing is always fixed using the image forming start as a basis. That is, it is clear that power correction should be executed at the point at which time (t1+t2−t3) has elapsed from the image forming start used as a basis. However, in the example of FIG. 4A, since the image forming operation is started without regard for the update timing of the power supply rate, the power correction start timing and the power supply rate update timing are not aligned. Thus, the power correction will actually be executed at a timing E or F at which the power supply rate is updated, which deviates from the timing at which power correction should originally have been started.

On the other hand, FIG. 4B is a timing chart in the case where image forming is started based on the power supply rate update timing of the present embodiment. In FIG. 4B, the point at which time (t1+t2−t3) has elapsed based on the start of image forming serves as the power correction start timing, similarly to FIG. 4A. Thus, the update timing is calculated in advance from the update period of the power supply rate, and the timing for sending the image forming operation start signal, which is the image forming start timing, is adjusted such that the point at which time (t1+t2−t3) has elapsed from the start of image forming coincides with the update timing of the power supply rate.

Next, derivation of the timing for sending the image forming operation start signal is described. The time from the image forming start to the power correction execution is always time (t1+t2−t3), and which period of the power supply rate update period R (in the present embodiment, 200 msec) this time corresponds to can be calculated in advance. In FIG. 4B, when the power supply rate update timing directly before the image forming start is taken as period 0, the power supply rate update timing of period n corresponds to the power correction start timing. That is, the following relational expression is established:

$$(n-1)\times R<(t1+t2-t3)<n\times R$$

Accordingly, when a time obtained by subtracting time (t1+t2−t3) from time (n×R) is defined as Tw, the power correction start timing and the update period of the power supply rate coincide if image forming is started after time Tw has elapsed using an arbitrary update timing of the power supply rate as a basis. Note that time Tw is a fixed value that can be calculated in advance depending on the apparatus configuration. In FIG. 4B, the start timing of the image forming operation is adjusted such that the power correction start timing and the power supply rate update timing coincide. Thus, the drop in temperature of the heating film 20 due to the printing material P entering the heating nip portion H decreases in degree, enabling the difference in gloss level that occurs at the position corresponding to where the first and second rotations of the heating film join in the image on the printing material P to be made less noticeable.

It was described above that the power correction start timing can be aligned using an arbitrary update timing of the power supply rate as a basis. However, it is preferable to select, as the power correction start timing, an update timing at which image forming can be started that is nearest the point at which the image forming preparatory operation (pre-rotation) ends. This is because there is no need to unnecessarily extend the update timing when viewed in terms of minimizing the print time of the image forming apparatus. The print time is minimized in the case where a point in time obtained by going back time Tw from the point in time at which the image forming preparation ends coincides with an update timing of the power supply rate. In view of this, it is most preferable to calculate the timing obtained by going back time Tw from the end point of the image forming preparatory operation, and to set the power correction start timing using the first power supply rate update timing after this timing as a basis. Note that in setting the power correction start timing, the power supply rate update timing used as a basis is appropriately determined depending on the apparatus configuration of the image forming apparatus, and the present invention is not limited to the above-mentioned timing. The criterion for determining whether image forming can be started also differs depending on the image forming apparatus.

Power Correction Control Procedure

Figure 5A:
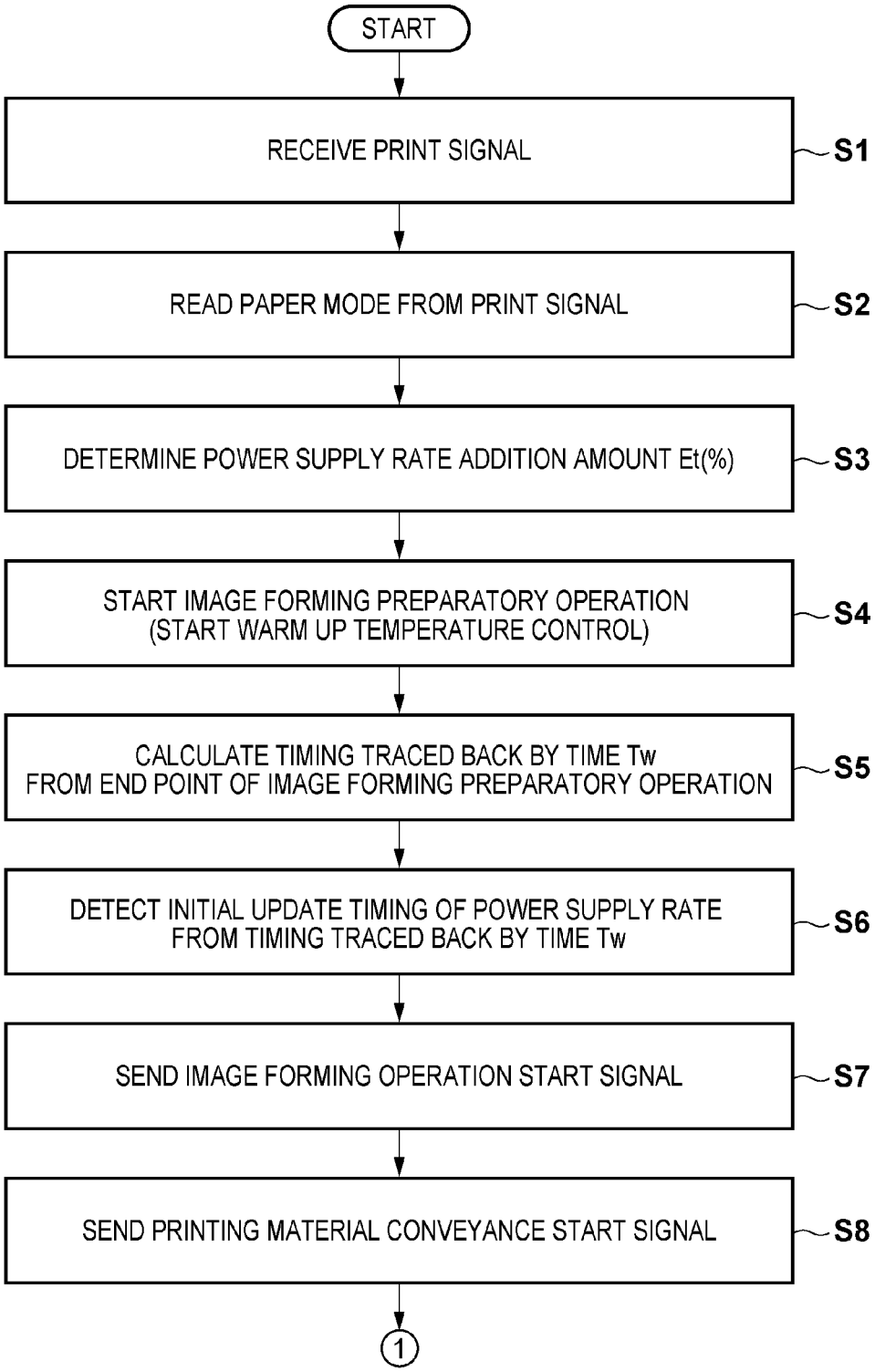
FIGS. 5A and 5B are flowcharts showing a power correction control procedure of Embodiment 1.
Figure 5B:
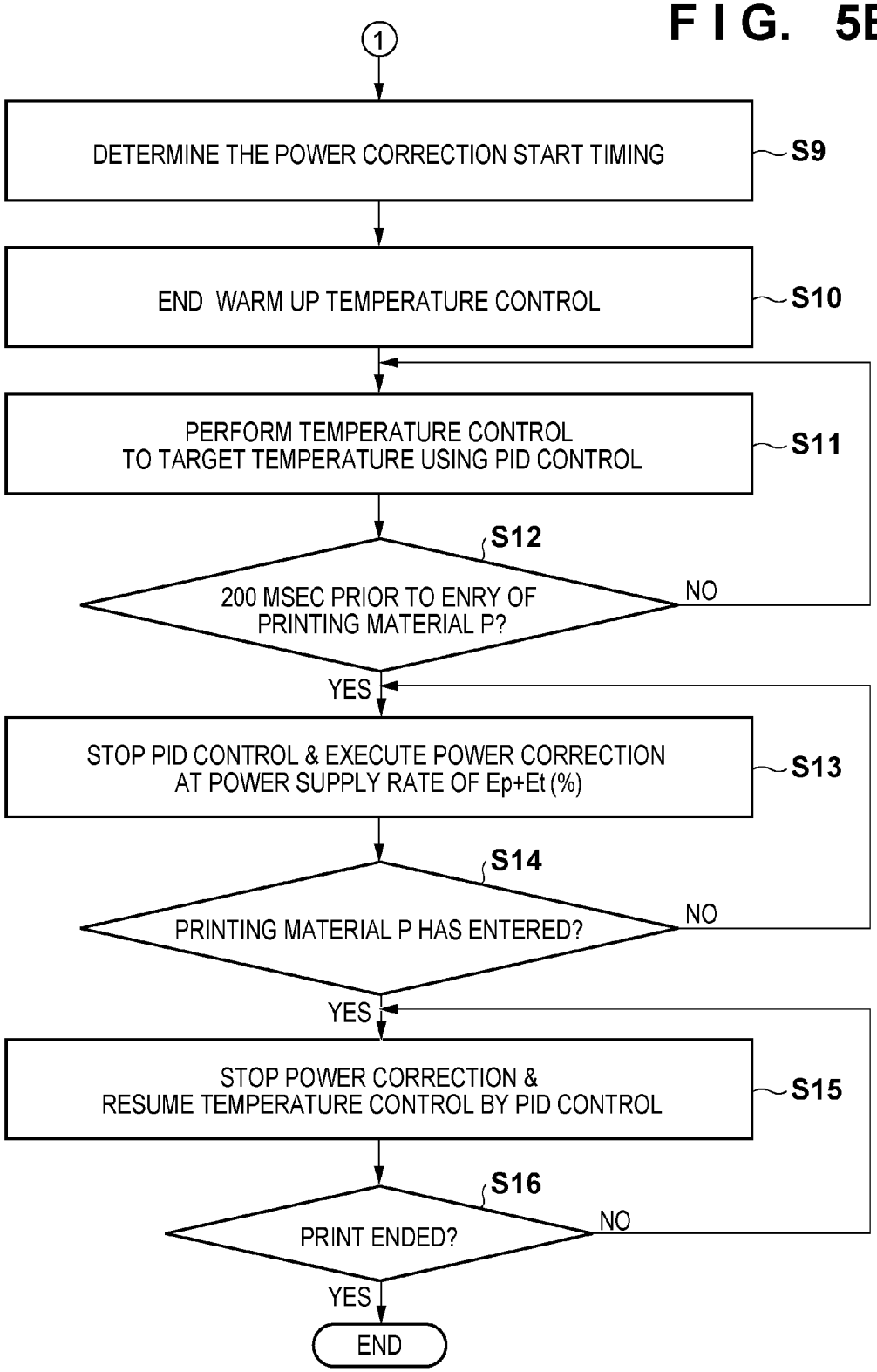

FIGS. 5A and 5B are flowcharts showing the power correction control procedure in the case of printing a single sheet of printing material in the present embodiment. This procedure is executed by the CPU 21 based on the program stored in the ROM. Note that the power supply frequency of the AC power supply 60 is given as 50 Hz, and the update period of the power supply rate is given as 200 msec. At the start of the flowchart of FIG. 5A, the power supply of the image forming apparatus is turned ON, and the CPU 21 enters a state of being able to receive a print signal for instructing printing of the printing material from an unshown host computer. Hereinafter, the power correction control procedure is described according to the flowchart of FIGS. 5A and 5B.

The CPU 21, on receipt of a print signal from the unshown host computer (step 1 (hereinafter, the steps are denoted as S1 and so on)), reads the paper mode indicating the type of printing material set in the print signal (S2). In the present embodiment, when correcting the power supplied to the heater 16, the difference in heat capacity due to the grammage ($g/m^2$) of the printing material P is taken into consideration, and the power supply used for power correction is changed according to the grammage of the printing material P. The CPU 21 corrects the amount of power supplied to the heater 16, in accordance with the contents of a table of required power values stored in the ROM and classified by paper mode. This is performed by transmitting paper mode information together with the print signal from the unshown host computer, as a result of a user specifying the paper mode.

The CPU 21 determines an additional amount Et (%) of power supply rate at the time of the correction corresponding to the paper mode, as shown in Table 1 (S3).

TABLE 1

| Grammage ($g/m^2$) | Paper mode | Power supply rate at time of correction |
|---|---|---|
| 60~70 | Thin paper | +5% |
| 71~90 | Normal | +10% |
| 91~128 | Thick paper 1 | +25% |
| 129~220 | Thick paper 2 | +35% |

In Table 1, power supply rate Et (%) to be added to the power supply rate Ep (%) selected using PID control directly before the start of power correction are indicated. Since the power supply rate Ep changes depending on the temperature of the heating film 20, only the power supply rate Et to be added at the time of power correction is determined at this point in time (at S3), and the power supply rate at the time of power correction is determined directly before power correction is started.

Next, the CPU 21 starts the image forming preparatory operation (S4). That is, the CPU 21 starts warm up temperature control of the heater 16 in order to control the heating film 20 to be at a prescribed temperature, by driving the heater driving circuit 28 together with charging of the photosensitive drum 2. The CPU 21 sets the timer so as to be able to detect the update period of the power supply rate, in order to perform temperature control of the heater 16, by periodically updating the power supply rate to the heater 16.

Meanwhile, when the leading edge position of the printing material P is detected by the registration sensor 47 after the printing material has been fed/conveyed by an unshown paper feeding mechanism, conveyance of the printing material P is stopped in a state where the leading edge is held at the position of the registration roller 46. Once the image forming preparatory operation ends, the CPU 21 calculates the timing obtained by going back the prescribed time Tw from the end point of the image forming preparatory operation (S5). The nearest power supply rate update timing to this timing is then calculated (S6). This calculated timing may be before or may be after the end point of the image forming preparatory operation. When it is detected using the timer that the prescribed time Tw has elapsed since updating of the power supply rate calculated by S6, the CPU 21 sends an image forming operation start signal to the image forming unit 1 and the like so as to start the image forming operation (S7). Note that the prescribed time Tw is defined by the following equation. Also, the meanings of the signs n, R, t1, t2, and t3 in the equation are as follows.

$$Tw=(n\times R)-(t1+t2-t3)$$

R: update period of power supply rate (msec)

t1: time from sending of image forming operation start signal to sending of printing material conveyance start signal (msec)

t2: predicted time (msec) from start of printing material conveyance to entry of printing material to heating nip portion H t3: time from start of power correction to entry of printing material to heating nip portion H (msec)

n: arbitrary number satisfying the following relational expression: $(n-1)\times R<(t1+t2-t3)<n\times R$ When it is detected using the timer that time t1 has elapsed from sending of the image forming operation start signal, the CPU 21 sends a printing material conveyance start signal to the registration roller 46, and starts conveyance of the printing material P (S8). Power correction is started after time (t2−t3) (first prescribed time) has elapsed from when conveyance of the printing material P was started, and, in the present embodiment as mentioned above, time t3 from the power correction start to entry of the printing material P to the heating nip portion H is 200 msec. The CPU 21 determines the power correction start timing, such that power correction is started at the point at which (t2−t3 (=200 msec)) msec has elapsed from sending of the printing material conveyance start signal (S9).

The CPU 21 ends warm up temperature control when it is detected by the main thermistor 18 that the temperature of the heating film 20 is near the prescribed temperature (S10). The CPU 21 controls the temperature of the heating film 20 to be at the target temperature by performing PID control in which a print temperature of 190° C. is set as the target temperature (S11).

The CPU 21 judges with the timer whether time (t2−t3 (=200 msec)) has elapsed from the conveyance start of the printing material P, and if it has not elapsed, processing of S11 is repeated (S12). The CPU 21 stops PID control when it is judged with the timer that the power correction start timing has arrived. The CPU 21 performs power correction in which an amount of power obtained by adding the prescribed power supply rate Et (%) derived from Table 1 to the power supply rate Ep (%) used in the directly previous PID control is output to the heater 16 as the power supplied at the time of power correction. Power is continuously supplied at the power supply rate (Ep+Et) (%) until the printing material P enters the heating nip portion H (S13).

The CPU 21 judges whether the power correction time period (=200 mesec) has elapsed, and repeats the processing of S13 in the case where it is judged using the timer that the power correction time period has not elapsed (S14). When it is detected using the timer that the power correction time period elapsed (S14), the CPU 21 stops power correction and resumes PID control in which a print temperature of 190° C. is set as the target temperature (S15).

The CPU 21 continues the above image forming operation until the end of printing (S16), and ends temperature control on the heater 16 once printing has ended.

Incidentally, the above-mentioned control procedure is also applicable in the case of continuous printing. In the case of continuous printing, a prescribed time is set for the image forming interval of the printing material (feed interval of printing material). In the above-mentioned control procedure, since the image forming start timing is determined based on the power supply rate update timing, variation in the image forming interval occurs within the power supply rate update period. In the present embodiment, basic control, even with continuous printing, is similar to the case of single sheet printing, and the image forming start timing from the second sheet onward can be determined, using the first power supply rate update timing from the timing obtained by going back time Tw from the point at which it becomes possible to start image forming as a basis. In the case where, however, the image forming interval of the printing material is set to allow some leeway with respect to the time at which it becomes possible to start image forming, the nearest power supply rate update timing to the timing at which it becomes possible to start image forming need not necessarily be used as a basis. For example, while the image forming interval with an image forming apparatus having a throughput of 30 sheets/minute will be 2.0 seconds, in the case where it becomes possible to start image forming on the second sheet of the printing material 1.9 seconds after the image forming on the first sheet, the nearest timing may be calculated using the 2.0 second interval as a basis rather than the 1.9 second interval.

As described above, the present embodiment enables temperature fluctuation of the heating nip portion following entry of the printing material to the heating nip portion H to be controlled, and gloss unevenness of the image on the printing material to be reduced, by correcting the power supplied to the heater for a fixed time before the entry timing of the printing material.

In the present embodiment, deviation of the power correction start timing from the proper timing can be prevented, by calculating the power supply rate update timing before the start of image forming, and aligning the image forming start timing with the power supply rate update timing. As a result, hot offset and the like can be prevented, temperature fluctuation of the heating nip portion H following entry of the printing material can be controlled, and gloss unevenness of the image on the printing material can be reduced. Further, harmonic current can be controlled since this power correction is applicable as power control in wave number control having a long power supply rate update period, and a low cost apparatus configuration is realizable since a noise filter is not required.

Embodiment 2

In Embodiment 1, the power supply rate update timing and the power correction start timing were made to coincide, by adjusting the image forming start timing based on the power supply rate update timing. The power correction start timing is determined based on the entry timing of the printing material P to the heating nip portion H, with the entry timing of the printing material P to the heating nip portion H being predicted using the conveyance start timing of the printing material P by the registration roller 46 as a basis in the present embodiment. Since the conveyance start of the printing material P can be accurately detected with operation of the registration roller 46, the power correction timing can be determined using the conveyance start timing of the printing material P as a basis, regardless of the image forming start timing. Accordingly, it can be said that adjusting the conveyance start timing of the printing material P based on the power supply rate update timing is more essential as a power correction control procedure in matching the power correction timing and the power supply rate update timing. As long as it is based on this concept, it need not necessarily be the image forming start timing that is adjusted according to the power supply rate update timing. That is, even with the image forming apparatus described in Embodiment 1, the power correction timing and the power supply rate update timing can be aligned similarly to Embodiment 1, provided conveyance of the printing material P is started after a time Tm has elapsed from an arbitrary power supply rate update timing in accordance with the following equation. Note that the meanings of the signs n, R, t2, and t3 in the equation are as follows.

$$Tm=(n\times R)-(t2-t3)$$

R: update period of power supply rate (msec)

t2: predicted time (msec) from start of printing material conveyance to entry of printing material to heating nip portion H t3: time from start of power correction to entry of printing material to heating nip portion H (msec)

n: arbitrary number satisfying the following relational expression: $(n-1)\times R<(t2-t3)<n\times R$ Note that with the configuration of the image forming apparatus of Embodiment 1, when only the printing material conveyance start timing is adjusted without adjusting the image forming start timing, the leading edge position of the image will actually shift. For example, in FIG. 4B, when the conveyance start of the printing material P shifts forward or backward of time t1 from the image forming start, the leading edge position of the image on the printing material will also shift from the original position. Accordingly, with the above-mentioned method, it is better to adopt a measure such as performing further adding fine adjustment after having adjusted the image forming start timing beforehand based on the power supply rate update timing.

Incidentally, depending on the configuration of the image forming apparatus, the image forming start timing may also be after the conveyance start of the printing material. For example, this will be the case when the time taken for an image (toner image) to move from the image forming starting position to a transfer portion is shorter than the time needed for the printing material to be conveyed from the conveyance starting position to the transfer portion, in which case it is necessary to adjust the conveyance start timing of the printing material using the above-mentioned equation for calculating time Tm. Hereinafter, power correction control in the case where the image forming start timing comes after the conveyance start of the printing material is described.

Outline of Image Forming Apparatus

Figure 6A:
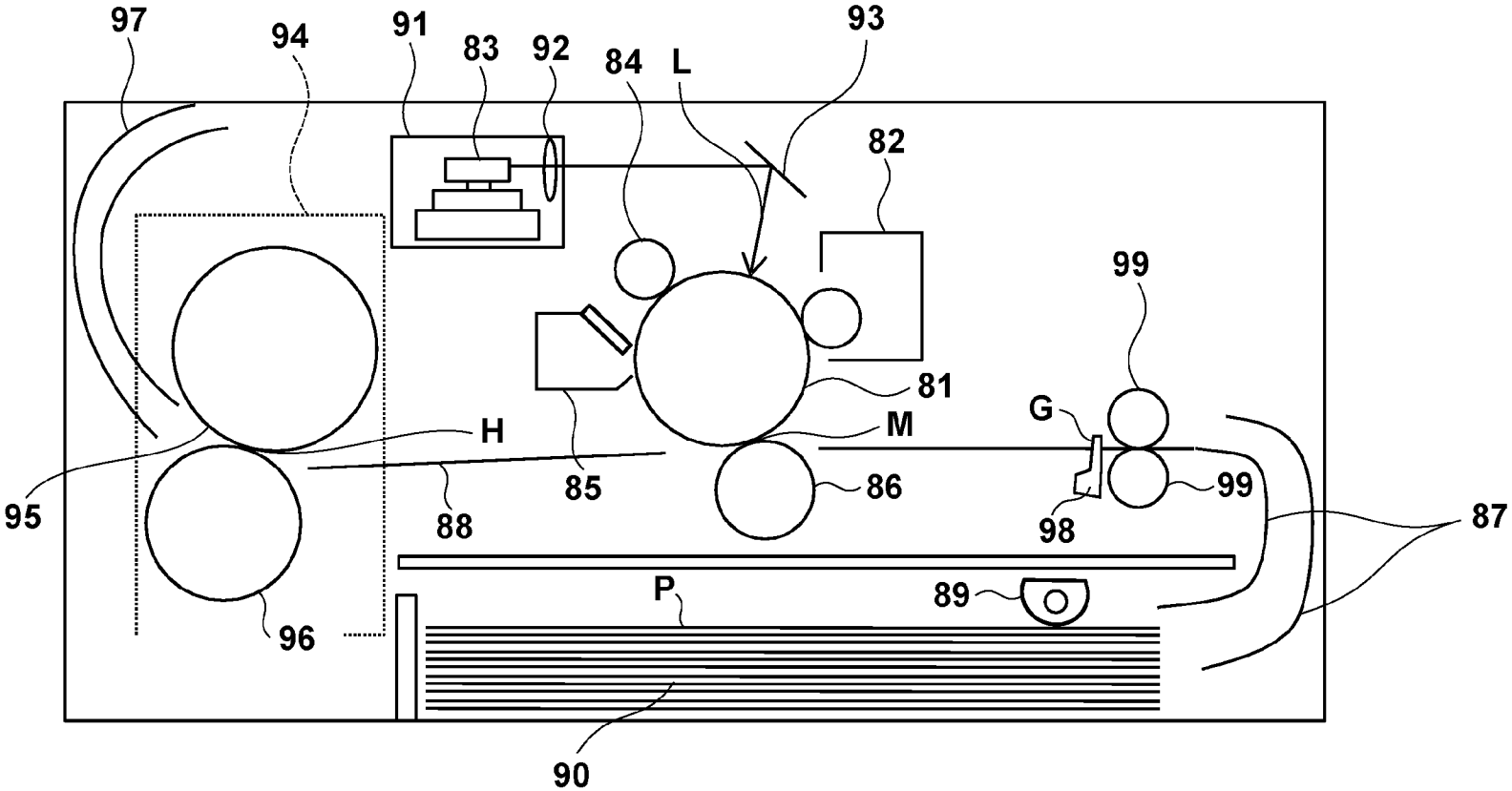
FIG. 6A is a cross-sectional view showing the configuration of an image forming apparatus of Embodiment 2.

FIG. 6A is a cross-sectional view showing the configuration of the image forming apparatus of the present embodiment. The image forming apparatus of the present embodiment is a monochrome laser printer that used an electrophotographic method. When a print signal from a host computer (not shown) is input to the image forming apparatus, driving of the image forming apparatus is started, and the printing material P is fed from a paper feed cassette 90 serving as a paper feed port by a paper feed roller 89. The printing material P is guided by a paper feed guide 87, and the leading edge of the printing material P arrives at the position of a registration roller 99 on the conveyance path. Here, once the leading edge position is detected by a registration sensor 98, conveyance of the printing material P is stopped in this state.

Prior to this, a photosensitive drum 81 is charged with a charging roller 84, and image forming preparation is performed. When conveyance of the printing material P is resumed at a desired timing by the registration roller 99, laser light corresponding to the image signal is irradiated from a laser scanning exposure apparatus 91 at a measured timing, and an electrostatic latent image is formed on the photosensitive drum 81. The laser scanning exposure apparatus 91 reflects the laser light off a rotary polygon mirror 83 that rotates, focuses the reflected light with a lens 92, and irradiates the focused light onto the photosensitive drum 81 with a folding mirror 93 or the like. The electrostatic latent image thus formed is visualized as a toner image by a developing apparatus 82, and moved to the transfer portion M following rotation of the photosensitive drum 81. Meanwhile, the conveyed printing material P reaches the transfer portion M which is opposed to a transfer roller 86 positioned below the photosensitive drum 81. At the transfer portion M, the toner image is transferred to the printing material P by the transfer roller 86 applying an electric field of opposite polarity to the toner from the back surface (back side) of the printing material P. Untransferred toner remaining on the photosensitive drum 81 is cleaned by a cleaning apparatus 85. The printing material P to which the toner image has been transferred is guided by a conveyance guide 88 and conveyed to a fixing apparatus 94, where heat and pressure are applied, and the toner image is fixed on the printing material P. The fixing apparatus 94 of the present embodiment employs a film heating method similar to Embodiment 1, and a heating film 95 is drivingly rotated by the rotational drive of a pressure roller 96, and heats as well as conveys the printing material P that has entered the heating nip portion H. The printing material P that has undergone fixing of the toner image by heat is guided by a conveyance guide 97, and discharged as an image formed product (print, copy).

Setting of Power Correction Timing (1) Relation Between Image Forming Start Timing and Conveyance Start Timing of Printing Material In FIG. 6A, the time needed for the printing material P to be conveyed the distance from a position G of a registration roller 99 to the transfer portion M is defined as T (G~M). Similarly, the time needed for the electrostatic latent image formed at an image forming position (electrostatic latent image forming position=laser light irradiation position) L on the photosensitive drum 81 to be developed into a toner image and move to the transfer portion M is defined as T (L~M). In FIG. 6A, the conveyance speed of the printing material P and the rotation speed of the photosensitive drum 81 are the same, and the size relation between time T (L~M) and the time T (G~M) will be T (L~M)<T (G~M). Note that at the point in time at which the leading edge of the printing material P is detected by the registration sensor 98, the position G of the registration roller 99 is set so as to coincide with the image forming position on the printing material P. In order to perform transfer with the leading edge of the image on the photosensitive drum 81 aligned with the image forming position of the printing material P, image forming needs to be started at the point at which the time needed for the image forming position of the printing material P to be transported to the transfer portion M after the printing material P has been conveyed equals time T (L~M). Accordingly, when image forming is started at position L on the photosensitive drum 81 before conveyance of the printing material P is started from position G of the registration roller 99, the image will not be aligned with the printing material P, given the relation T (L~M)<T (G~M). Hence, as mentioned above, with the image forming apparatus having the present configuration, image forming at position L on the photosensitive drum 81 has to be started after conveyance of the printing material P by the registration roller 99 has been started.

(2) Timing Chart for Power Correction Control

Figure 6B:
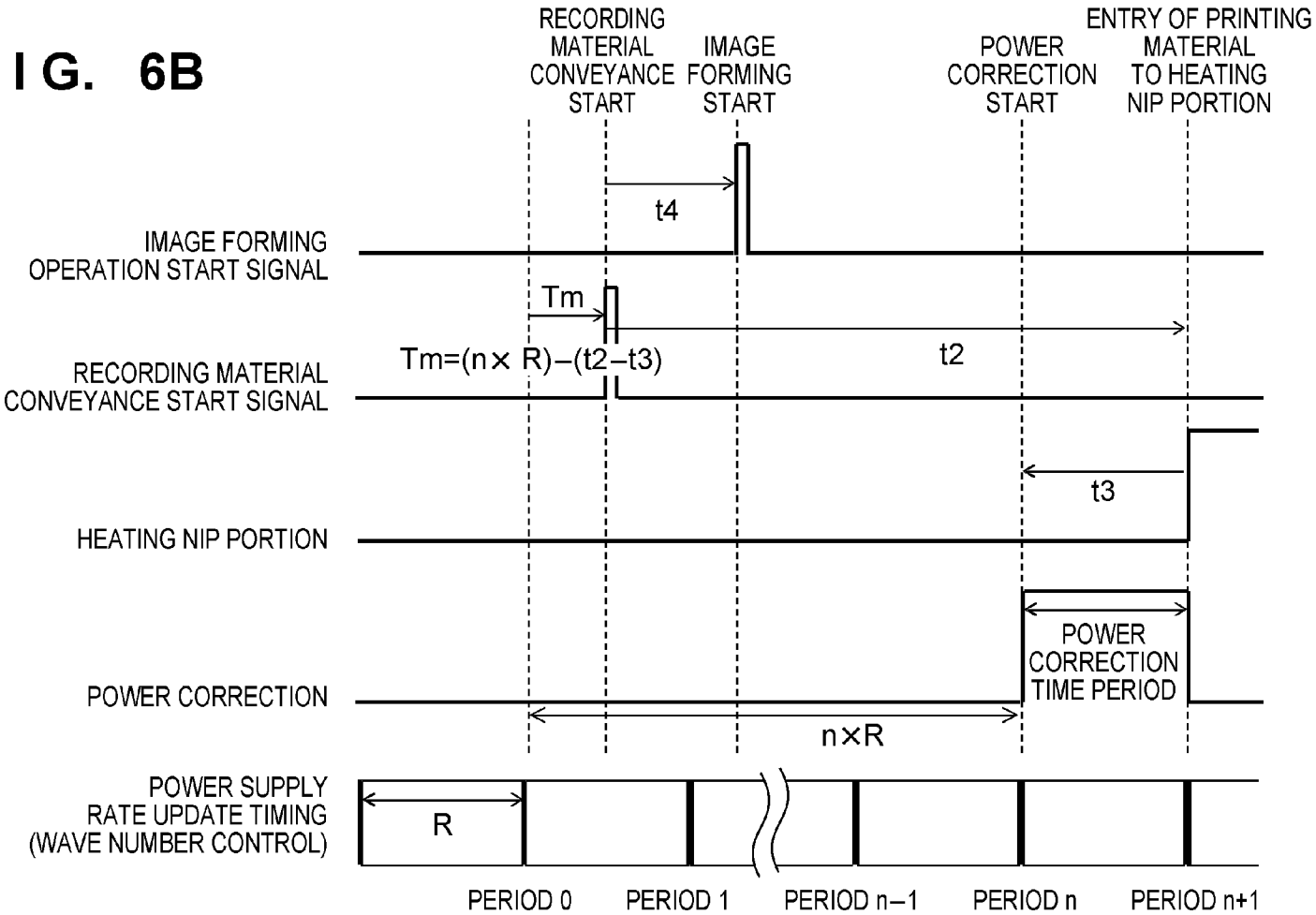
FIG. 6B is a timing chart showing power supply rate update timing and printing material conveyance start timing.

FIG. 6B shows a timing chart for the configuration of the image forming apparatus of the present embodiment. In FIG. 6B, when the image forming preparatory operation ends and a printing material conveyance start signal is output, the printing material is conveyed, and image forming is started after an image forming operation start signal is output after time t4 (fourth prescribed time) has elapsed. The printing material P enters the heating nip portion H after time t2 has elapsed from the printing material conveyance start. Power correction is then started time t3 before (in the present embodiment, 200 msec before) this timing after counting back. Time t4 is the adjustment time for aligning the image forming starting position on the printing material and the leading edge of the toner image on the photosensitive drum at the transfer portion M. Incidentally, since times t2 and t3 are fixed values, the power correction start timing is a timing that is always fixed using the printing material conveyance start as a basis. That is, it is clear that the timing at which power correction should be executed is the point at which time (t2−t3) has elapsed from the printing material conveyance start used as a basis. Thus, the update timing is calculated in advance from the update period of the power supply rate, and the timing for sending the printing material conveyance start signal, which is the printing material conveyance start timing, is adjusted such that the point at which time (T2−T3) has elapsed from the printing material conveyance start coincides with the power supply rate update timing. The power correction timing and the power supply rate update timing can be aligned similarly to Embodiment 1, provided conveyance of the printing material P is started after the above-mentioned time Tm (=(n×R)−(t2−t3)) has elapsed from an arbitrary power supply rate update timing.

As described above, according to the present invention, temperature fluctuation of the heating nip portion following entry of the printing material can be controlled, and gloss unevenness of the image on the printing material can be reduced. Note that although a monochrome laser printer was used as an image forming apparatus in the description of the present embodiment, the apparatus configuration is not limited thereto, and an essential requirement in terms of apparatus configuration is that conveyance of the printing material starts before the start of image forming. Also, although not to the same extent as a color image forming apparatus, gloss unevenness arises even with monochrome image forming apparatus, since heating unevenness occurs where the first and second rotations of the heating film join. Accordingly, the present invention is also useful for a monochrome image forming apparatus.

Other Embodiments (1) Paper Mode

In Embodiment 1, although only grammage is set as a paper mode, differences due to the surface texture of the printing material P or the like may be included as paper modes. Because so-called rough paper whose printing material surface has inferior smoothness, glossy paper whose texture is very smooth, and film-based printing material such as OHT differ from normal print paper in terms of heat capacity and heat conductivity from the fixing apparatus to the printing material P, the power used in power correction also differs.

Accordingly, more optimal power correction control can be performed, by changing the power correction value according to these types of printing material.

Figure 7A:
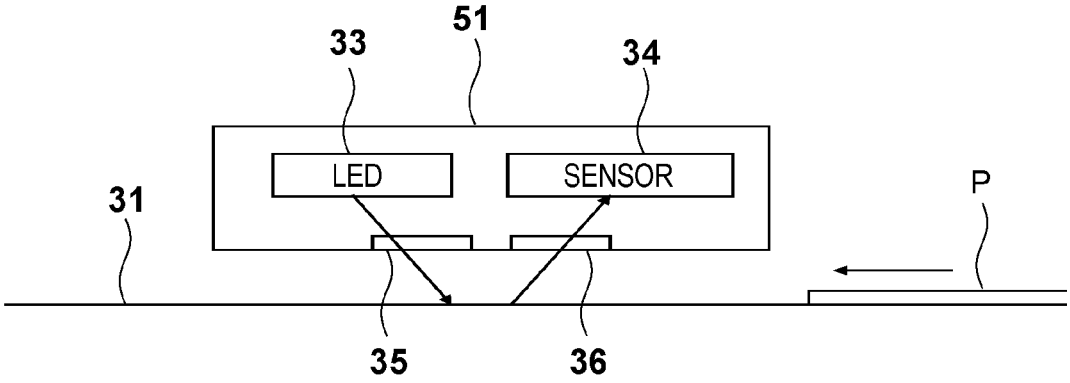
FIG. 7A is a cross-sectional view showing the configuration of a media sensor.

In Embodiment 1, it assumed that a user transmits media information through a host computer, although a result determined with the media sensor 51 which detects the optical reflectance of the printing material can also be used, without depending on a user specification. As shown in FIG. 1, the media sensor 51 is disposed in the image forming apparatus of Embodiment 1, and the cross-sectional view of the media sensor 51 is shown in FIG. 7A. The media sensor 51 has an LED 33 serving as a light source, a CMOS sensor 34 serving as a reading unit, and lenses 35 and 36 serving as imaging lenses. Light whose light source is the LED 33 is irradiated onto a printing material conveyance guide 31 or the surface of the printing material P on the printing material conveyance guide 31, via the lens 35. This reflected light is condensed via the lens 36 and forms an image on the CMOS sensor 34. The surface image of the printing material conveyance guide 31 or the printing material P is thereby read. The surface state of the paper fiber of the printing material P is read as a result, and the analog output thereof is A/D converted to digital data. A gain operation and a filter operation on the digital data are processed by a control processor (not shown), an image comparison operation is performed, and the paper type is determined based on the image comparison operation result.

(2) Other Power Supply Control

In Embodiments 1 and 2, wave number control was used for power supply control, although control that combines wave number control and phase control can also be used. This involves controlling the power supply rate in a prescribed period, with inclusion of waveforms for performing ON (100% power supply) and OFF (0% power supply) control on all half waves within a prescribed period as with wave number control, and waveforms for performing phase control on half waves within the same period by controlling the phase angle. That is, this is basically wave number control in which one or more half waves are taken as one unit, with phase control being performed on the half waves included therein, and, hereinafter, this control is referred to as "hybrid control". With hybrid control, since waveforms for performing phase control within one update period are included, the power supply rate can be finely adjusted, the update period can be shortened in comparison to the case where the power supply rate is controlled with only wave number control, and the overall power supply rate can itself be finely adjusted. For example, with wave number control of 20 half waves, as mentioned above, the power supply rate can only be selected in 5% units, but with hybrid control it is also possible to set 1% units. Also, since phase control is only performed on a portion of the waves of the AC input voltage, settings can be configured such that any increase in harmonic current is suppressed as much as possible, in comparison to the case where the power supply rate is only controlled with phase control.

Figure 7B:
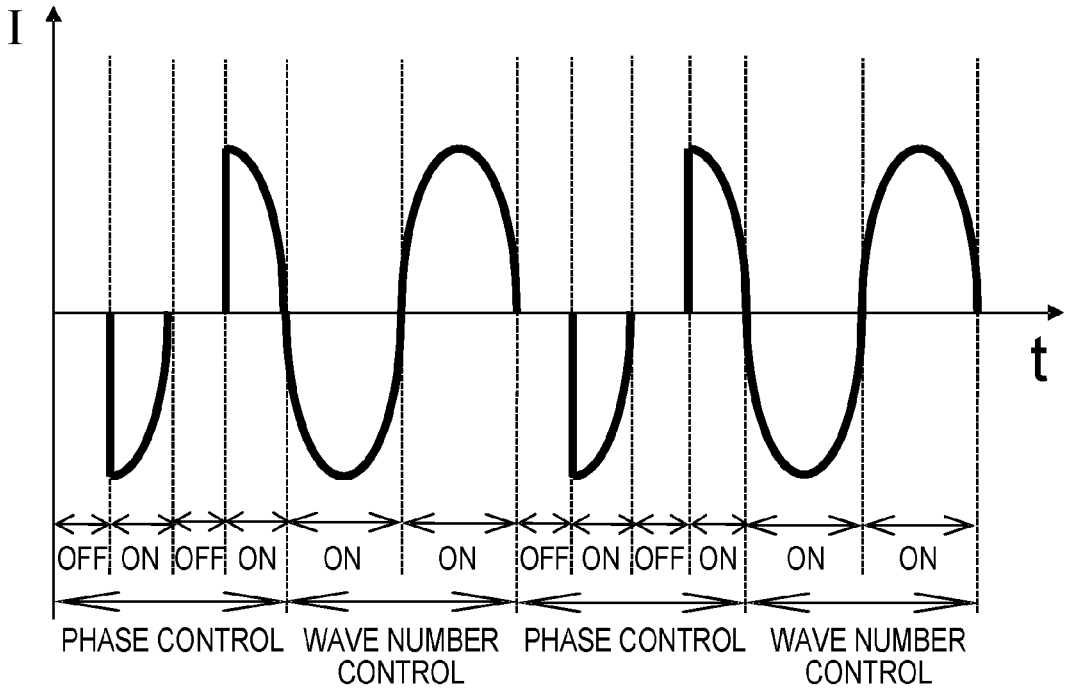
FIG. 7B shows the example of the power supply waveform pattern in hybrid control.
Figure 8:
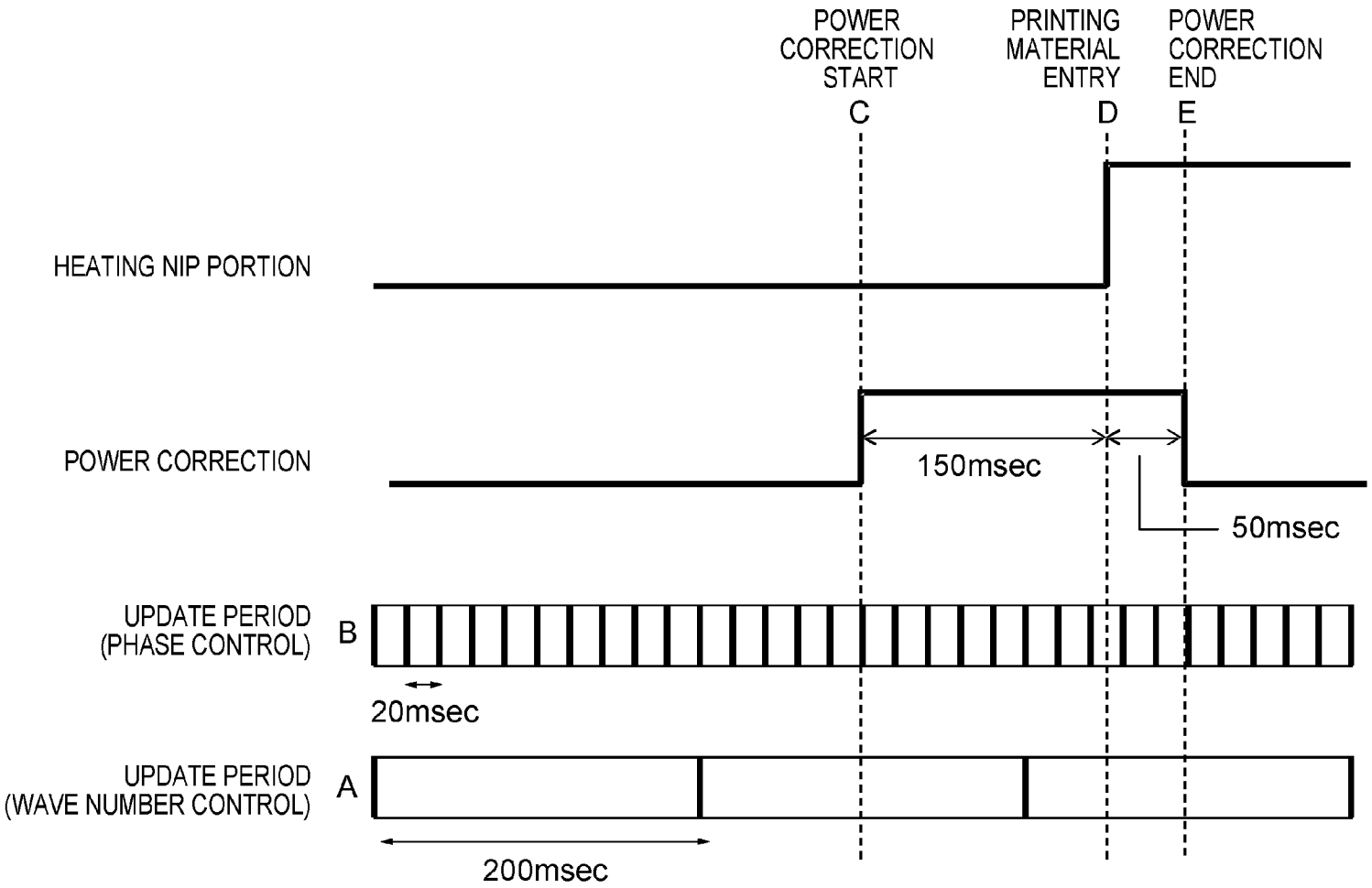
FIG. 8 is a timing chart showing power supply rate update timing for conventional wave number control and phase control, and timing for printing material entry and power correction.
Figure 9A:
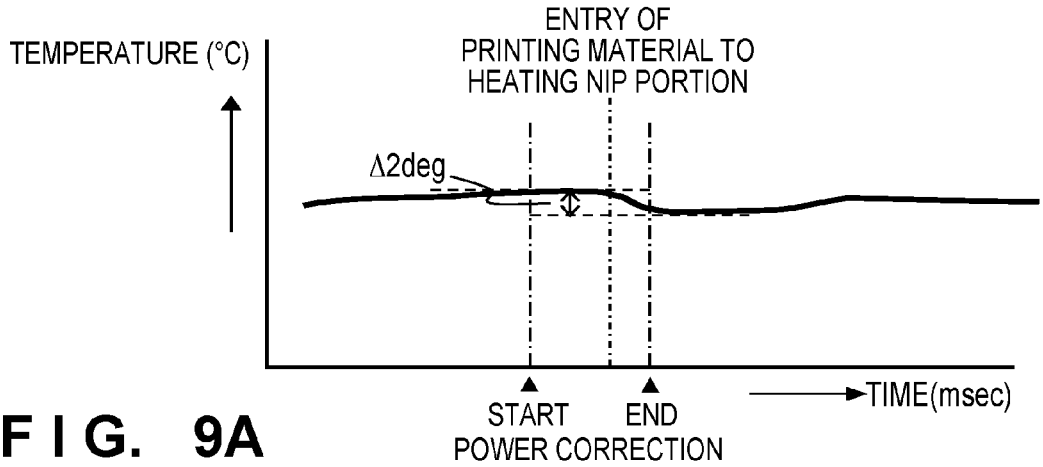
FIGS. 9A, 9B and 9C are graphs showing the temperature of a heating film surface depending on the timing at which power correction is performed.
Figure 9B:
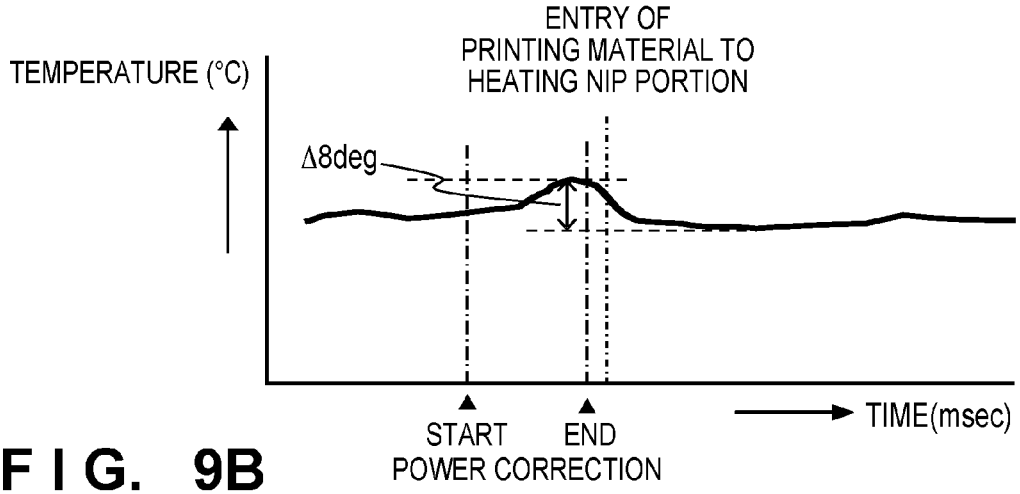
Figure 9C:
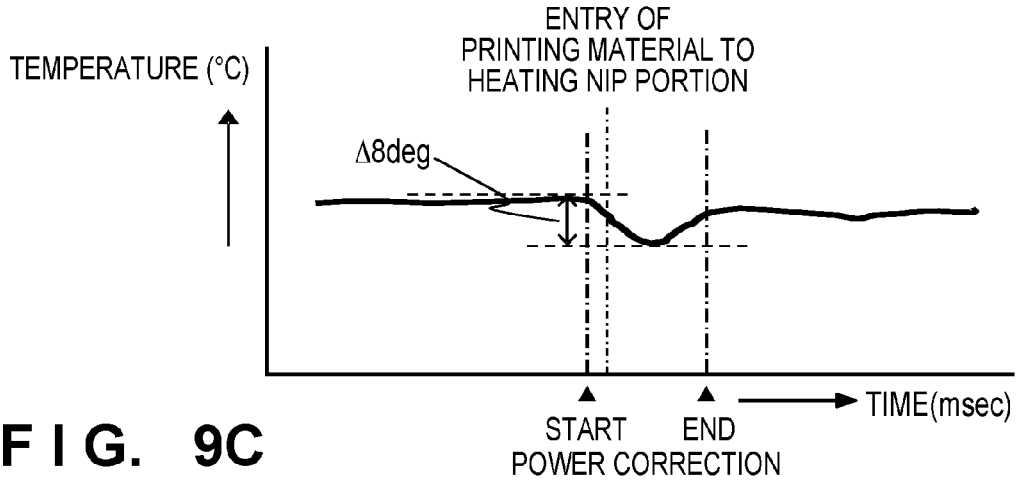

The waveform of the power supply current to the heater in the case of performing hybrid control is shown in FIG. 7B. FIG. 7B shows example hybrid control for updating the power supply rate in periods of 8 half waves. In Embodiments 1 and 2, the power correction time period was given as 200 msec, being from 200 msec before entry of the printing material to the heating nip portion H up until entry. Since the update period is 80 msec in the case of hybrid control for controlling the power supply rate in units of 8 half waves shown in FIG. 7B, a time of 200 msec cannot be partitioned. Accordingly, aligning the power correction time period with the update period of the power supply rate, such as, for example, setting the power correction time period to 160 msec, being from 160 msec before entry of the printing material to the heating nip portion H up until entry, is preferable in terms of control. Alternatively, in the case of maintaining a correction period of 200 msec, it is preferable to use hybrid control of 10 half wave, giving an update period of 100 msec.

Also, an effect is obtained even when the above-mentioned embodiments are applied to an apparatus that performs phase control, given the operation principles thereof. Since the power supply rate update period of phase control is short, alignment of the power supply rate update timing and the power correction timing is facilitated. Accordingly, a high quality image with little gloss unevenness can be obtained by aligning the power supply rate update timing and the power correction timing as in the above-mentioned embodiments. Note that in the above-mentioned embodiments, with regard to the power correction timing, settings were configured such that power correction is started before entry of the printing material to the heating nip portion H and ends at the same time as entry, but power correction may, for example, be performed so as to span the period before and after entry of the printing material to the heating nip portion H. The power correction timing can also be set so as to end power correction before entry of the printing material. This is because the power correction time period is set on the assumption that there will be a time lag between the supply power to the heater and the rise in temperature of the heater.

As described above in the other embodiments, by using phase control or hybrid control combining wave number control and phase control as power supply control, temperature fluctuation in the heating nip portion following entry of the printing material can be controlled, and gloss unevenness of the image on the printing material can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-274586, filed on Dec. 9, 2010, that is hereby incorporated by reference herein in its entirety.

What is claimed is:

1. An image forming apparatus comprising:

an image forming unit configured to form an unfixed toner image on a printing material;

a printing material conveying unit configured to convey the printing material to the image forming unit;

a fixing unit configured to fix the unfixed toner image on the printing material to the printing material by heat;

a temperature detecting unit configured to detect a temperature of the fixing unit; and a control unit configured to control the apparatus, the control unit updating, every power supply update period, power supplied to the fixing unit from an AC power supply in accordance with the temperature detected by the temperature detecting unit, where the power supply update period corresponds to a prescribed number of continuous half waves of the AC power supply, wherein the control unit is further configured to adjust a timing at which to start conveying printing material from the printing material conveying unit, based on a power supply update timing of the power supply update period.

2. The image forming apparatus according to claim 1, wherein the control unit is further configured to correct the power supplied to the fixing unit, based on a timing at which a leading edge of the printing material enters the fixing unit.

3. The image forming apparatus according to claim 2, wherein the control unit is further configured to calculate the printing material conveyance start timing based on the power supply update timing, and start correction of the power supplied to the fixing unit after a prescribed period from the calculated timing.

4. The image forming apparatus according to claim 1, wherein the fixing unit includes:

an endless belt;

a heater that contacts an inner surface of the endless belt; and a pressure roller that forms a nip portion where a fixing process is performed on the printing material having the unfixed toner image formed thereon, together with the heater via the endless belt, and wherein power from the AC power supply is supplied to the heater.

5. The image forming apparatus according to claim 2, wherein a power correction time period ends with one of: a timing when the leading edge of the printing material enters the fixing unit, a timing before the leading edge of the printing material enters the fixing unit, and a timing after the leading edge of the printing material enters the fixing unit.

6. The image forming apparatus according to claim 2, wherein a power correction time period is equal to an integral multiple of the power supply update period.

7. The image forming apparatus according to claim 2, wherein the control unit is further configured to resume a control in which the power supplied to the fixing unit is controlled in accordance with the temperature detected by the temperature detecting unit after a power correction time period is finished, and continue the control until an end of printing.

8. The image forming apparatus according to claim 2, wherein the control unit is further configured to set corrected power in accordance with a type of the printing material.

9. The image forming apparatus according to claim 1, wherein the control unit is further configured to adjust a timing at which to start forming the unfixed toner image based on the power supply update timing.

10. An image forming apparatus comprising:

an image forming unit configured to form an unfixed toner image on a printing material;

a printing material conveying unit configured to convey the printing material to the image forming unit;

a fixing unit configured to fix the unfixed toner image on the printing material to the printing material by heat;

a temperature detecting unit configured to detect a temperature of the fixing unit; and a control unit configured to control the apparatus, the control unit updating, every power supply update period, power supplied to the fixing unit from an AC power supply in accordance with the temperature detected by the temperature detecting unit, where the power supply update period corresponds to a prescribed number of continuous half waves of the AC power supply, wherein the control unit is further configured to adjust a timing at which to start forming the unfixed toner image based on a power supply update timing of the power supply update period.

11. The image forming apparatus according to claim 10, wherein the control unit is further configured to correct the power supplied to the fixing unit, based on a timing at which a leading edge of the printing material enters the fixing unit.

12. The image forming apparatus according to claim 11, wherein the control unit is further configured to calculate an image forming start timing based on the power supply update timing, and start correction of the power supplied to the fixing unit after a prescribed period from the calculated timing.

13. The image forming apparatus according to claim 11, wherein a power correction time period ends with one of: a timing when the leading edge of the printing material enters the fixing unit, a timing before the leading edge of the printing material enters the fixing unit, and a timing after the leading edge of the printing material enters the fixing unit.

14. The image forming apparatus according to claim 11, wherein a power correction time period is equal to an integral multiple of the power supply update period.

15. The image forming apparatus according to claim 11, wherein the control unit is further configured to resume a control in which the power supplied to the fixing unit is controlled in accordance with the temperature detected by the temperature detecting unit after a power correction time period is finished, and continue the control until an end of printing.

16. The image forming apparatus according to claim 11, wherein the control unit is further configured to set corrected power in accordance with a type of the printing material.

17. The image forming apparatus according to claim 10, wherein the fixing unit includes:

an endless belt;

a heater that contacts an inner surface of the endless belt; and a pressure roller that forms a nip portion where a fixing process is performed on the printing material having the unfixed toner image formed thereon, together with the heater via the endless belt, and wherein power from the AC power supply is supplied to the heater.

* * * * *